US008579837B1

(12) United States Patent
Makower et al.

(10) Patent No.: US 8,579,837 B1
(45) Date of Patent: Nov. 12, 2013

(54) DEVICES AND METHODS FOR PROMOTING FEMALE SEXUAL WELLNESS

(71) Applicant: ExploraMed NC6, LLC, Mountain View, CA (US)

(72) Inventors: Joshua Makower, Los Altos Hills, CA (US); Eric Goldfarb, Belmont, CA (US); Arthur Ferdinand, San Jose, CA (US)

(73) Assignee: ExploraMed NC6, LLC, Mountain View, CA (US)

( * ) Notice: Subject to any disclaimer, the term of this patent is extended or adjusted under 35 U.S.C. 154(b) by 0 days.

(21) Appl. No.: 13/874,335

(22) Filed: Apr. 30, 2013

Related U.S. Application Data

(63) Continuation of application No. 13/798,085, filed on Mar. 13, 2013.

(60) Provisional application No. 61/731,487, filed on Nov. 30, 2012, provisional application No. 61/729,231, filed on Nov. 21, 2012.

(51) Int. Cl.
*A61H 1/00* (2006.01)

(52) U.S. Cl.
USPC ..... 601/6; 601/46

(58) Field of Classification Search
USPC ..... 601/6, 7, 9, 10, 11, 46, 67, 68, 69, 70, 601/72
See application file for complete search history.

(56) References Cited

U.S. PATENT DOCUMENTS

| | | | | |
|---|---|---|---|---|
| 123,887 | A | | 2/1872 | Gee |
| 816,748 | A | | 4/1906 | Saighman |
| 944,737 | A | | 12/1909 | Lombard |
| 1,025,504 | A | | 5/1912 | Birrell |
| 1,225,341 | A | | 5/1917 | Lederer |
| 2,024,983 | A | | 12/1935 | Street |
| 2,076,410 | A | | 4/1937 | McGerry |
| 2,112,646 | A | | 3/1938 | Biedermann |
| 2,519,790 | A | * | 8/1950 | Quinn ..... 601/6 |
| 2,559,059 | A | | 7/1951 | Worstenholm |
| 2,561,034 | A | | 7/1951 | Phillips |
| 3,375,381 | A | | 3/1968 | Tavel |
| 3,504,665 | A | | 4/1970 | Bakunin et al. |
| 3,626,931 | A | | 12/1971 | Bysakh |
| 3,744,486 | A | | 7/1973 | Wilson |
| 3,820,533 | A | | 6/1974 | Jones |
| 4,378,008 | A | | 3/1983 | Osbon, Sr. |
| 4,610,675 | A | | 9/1986 | Triunfol |
| 4,856,498 | A | | 8/1989 | Osbon |
| 5,115,800 | A | | 5/1992 | Matejevic et al. |
| 5,460,597 | A | | 10/1995 | Hopper |

(Continued)

FOREIGN PATENT DOCUMENTS

| | | |
|---|---|---|
| WO | WO2007089638 | 8/2007 |
| WO | WO2008086424 | 7/2008 |

OTHER PUBLICATIONS

Trojan, Vibrating Twister Intimate Massager and related packaging, packaging copyright 2009.
We Vibe, WV3 and related packaging; date unknown.

(Continued)

*Primary Examiner* — Steven Douglas

(57) ABSTRACT

Devices, systems, and methods for promoting female sexual wellness and function. The devices, systems, and methods encourage clitoral engorgement using suction over the clitoris combined with vibratory stimulation.

20 Claims, 30 Drawing Sheets

(56) References Cited

U.S. PATENT DOCUMENTS

| | | | | |
|---|---|---|---|---|
| 5,546,477 | A | 8/1996 | Knowles et al. | |
| 5,571,118 | A | 11/1996 | Boutos | |
| 5,693,002 | A | 12/1997 | Tucker et al. | |
| 5,725,473 | A | 3/1998 | Taylor | |
| 5,755,236 | A | 5/1998 | Dann et al. | |
| 5,813,973 | A | 9/1998 | Gloth | |
| 5,885,204 | A | 3/1999 | Vergano | |
| 5,895,349 | A | 4/1999 | Tihon | |
| 5,902,293 | A * | 5/1999 | Liu | 604/313 |
| 5,989,180 | A | 11/1999 | Norton | |
| 6,036,635 | A | 3/2000 | Altshuler | |
| 6,099,463 | A | 8/2000 | Hockhalter | |
| 6,169,914 | B1 | 1/2001 | Hovland et al. | |
| 6,179,775 | B1 | 1/2001 | Thompson | |
| 6,183,414 | B1 | 2/2001 | Wysor et al. | |
| 6,196,982 | B1 * | 3/2001 | Ball | 601/6 |
| D443,057 | S | 5/2001 | Hovland et al. | |
| 6,224,541 | B1 | 5/2001 | Thompson | |
| D449,690 | S | 10/2001 | Hovland et al. | |
| 6,464,653 | B1 | 10/2002 | Hovland et al. | |
| 6,599,236 | B1 | 7/2003 | Castro | |
| 6,733,438 | B1 | 5/2004 | Dann et al. | |
| 6,741,895 | B1 | 5/2004 | Gafni et al. | |
| 6,902,525 | B1 | 6/2005 | Jewell | |
| 6,905,459 | B2 | 6/2005 | Humphries, Jr. | |
| 6,923,755 | B2 | 8/2005 | Norma | |
| 6,949,067 | B1 | 9/2005 | Dann et al. | |
| 6,964,643 | B2 | 11/2005 | Hovland et al. | |
| 6,991,598 | B2 | 1/2006 | Klein | |
| 7,163,508 | B1 | 1/2007 | Washington | |
| 7,166,072 | B2 | 1/2007 | Smith | |
| 7,577,476 | B2 | 8/2009 | Hochman et al. | |
| 7,588,533 | B2 * | 9/2009 | Drysdale | 600/38 |
| 7,608,037 | B2 | 10/2009 | Levy | |
| 7,670,280 | B2 | 3/2010 | Gloth | |
| 7,784,466 | B2 | 8/2010 | Clodius-Talmadge | |
| 7,803,126 | B2 | 9/2010 | Nan | |
| 7,871,386 | B2 | 1/2011 | Nan | |
| 7,894,913 | B2 | 2/2011 | Boggs et al. | |
| 7,913,694 | B2 | 3/2011 | Clodius-Talmadge | |
| 7,967,740 | B2 | 6/2011 | Mertens et al. | |
| 8,047,984 | B2 | 11/2011 | Tasker et al. | |
| 8,093,767 | B2 | 1/2012 | Pepin et al. | |
| 8,147,399 | B2 | 4/2012 | Gloth | |
| 8,152,746 | B2 | 4/2012 | Nan | |
| 2003/0069470 | A1 | 4/2003 | Lee | |
| 2003/0162595 | A1 | 8/2003 | Serbanescu | |
| 2003/0195441 | A1 | 10/2003 | Firouzgar | |
| 2004/0171910 | A1 | 9/2004 | Moore-Steele | |
| 2005/0004429 | A1 | 1/2005 | Tracanna | |
| 2005/0075072 | A1 | 4/2005 | Apitzsch | |
| 2005/0244520 | A1 | 11/2005 | Thompson et al. | |
| 2006/0206163 | A1 | 9/2006 | Wahlstrand et al. | |
| 2006/0259027 | A1 | 11/2006 | Kwan et al. | |
| 2007/0049792 | A1 | 3/2007 | Levy | |
| 2007/0055096 | A1 | 3/2007 | Berry et al. | |
| 2007/0100259 | A1 | 5/2007 | Nan | |
| 2008/0071138 | A1 | 3/2008 | Mertens et al. | |
| 2008/0306332 | A1 | 12/2008 | Choi et al. | |
| 2009/0093856 | A1 | 4/2009 | Attila et al. | |
| 2009/0118573 | A1 | 5/2009 | Tsao | |
| 2009/0171144 | A1 | 7/2009 | Squicciarini | |
| 2009/0234182 | A1 | 9/2009 | Buchholz | |
| 2009/0270674 | A1 | 10/2009 | Trzecieski | |
| 2010/0289346 | A1 | 11/2010 | Pepin et al. | |
| 2011/0098613 | A1 | 4/2011 | Thomas | |
| 2011/0218395 | A1 | 9/2011 | Stout | |
| 2011/0319707 | A1 | 12/2011 | Mertens et al. | |
| 2012/0133308 | A1 | 5/2012 | Elenga et al. | |
| 2012/0172661 | A1 | 7/2012 | Chiu | |
| 2012/0197072 | A1 | 8/2012 | Cordle | |
| 2013/0116503 | A1 * | 5/2013 | Mertens et al. | 600/38 |
| 2013/0178769 | A1 * | 7/2013 | Schmidt | 601/46 |

OTHER PUBLICATIONS

Alzate and Hoch, "The 'G Spot'" and 'Female Ejaculation': A Current Appraisal, Journal of Sex & Marital Therapy, vol. 12, No. 3, Fall 1986, pp. 211-220.

Aslan and Fynes, "Female sexual dsyfunction," International Urogynecology Journal, 19: 293-305 (2008).

Billups, "The role of mechanical devices in treating female sexual dysfunction and enhancing the female sexual response," World Journal of Urology 20:137-141 (2002).

Clayton et al, "Intended or Unintended Consequences? The Likely Implications of Raising the Bar for Sexual Dysfunction Diagnosis in the Proposed DSM-V Revisions: 1. For Women with Incomplete Loss of Desire or Sexual Receptivity," J Sex Med 2012; 9:2027-2039.

Davis et al, "Characteristics of Vibrator Use Among Women," J. Sex Res. vol. 33, No. 4, 1996 pp. 313-320.

Fenner, "Experts debate—should DSM-V raise the bar for female sexual dysfunction diagnosis?" Nat. Rev. Urol. 9, 475 (2012).

Helpman et al, "Genito-Sensory Analysis in Women with Arousal and Orgasmic Dysfunction," J. Sex. Med. 2009; 6:1039-1044.

Herbenick et al, "Prevalence and Characteristics of Vibrator Use by Women in the United States: Results from a Nationally Representative Study," J Sex Med 2009;6:1857-1866.

Herbenick et al, "Women's Vibrator Use in Sexual Partnerships: Results From a Nationally Representative Survey in the United States," Journal of Sex & Marital Therapy, 36:49-65, 2010.

Herbenick et al, "Beliefs About Women's Vibrator Use: Results From a Nationally Representative Probability Survey in the United States," Journal of Sex & Marital Therapy, 37:329-345, 2011.

Hoch, "Vaginal Erotic Sensitivity by Sexological Examination," Acta Obstet Gynecol Scand 65:767-773, 1986.

Krantz, "Innervation of the Human Vulva and Vagina: A microscopic study." Obstetrics and Gynecology 12(4) 382-392 (1958).

Miller and Hunt, "Female Sexual Dysfunction: Review of the Disorder and Evidence for Available Treatment Alternatives," Journal of Pharmacy Practice 2003.16;3:200-208.

Pipeline_Review, Female Sexual Dysfunction—Pipeline Review, H1 2012, Mar. 2012.

Prause et al, "Clinical and research concerns with vibratory stimulation: a review and pilot study of common stimulation devices," Sexual and Relationship Therapy, vol. 27, No. 1, Feb. 2012, 17-34.

Traish et al, "Biochemical Factors Modulating Female Genital Sexual Arousal Physiology," J Sex Med 2010; 7:2925-2946.

Winkelmann, "The Erogenous Zones: Their Nerve Supply and its Significance," Staff Mtngs. Mayo Clin. vol. 34, No. 2, pp. 39-47, 1959.

Yamada, "Studies on the Innervation of Clitoris in 10th Month Human Embryo," The Tohoku Journal of Experimental Medicine, vol. 54, No. 2, pp. 151-157, 1951.

Goldstein et al, "Vasculogenic female sexual dysfunction: vaginal engorgement and clitoral erectile insufficiency syndromes" Int. J. Impotence Res. (1998) 10, Suppl 2, S84-S90.

Allation, Vibrating Mini Personal Massager and related packaging, packaging copyright 2012.

Body Innovations, Mini Massager and related packaging, packaging copyright 2011.

California Exotic Novelties, Aphrodite massager and related packaging, packaging copyright 2005, 2011.

California Exotic Novelties, Hyper Bunny and related packaging, packaging copyright 2007.

California Exotic Novelties, Little Black Panty and related packaging, packaging copyright 2011.

California Exotic Novelties, Micro Butterfly and related packaging, packaging copyright 1996; image produced Dec. 26, 1996.

California Exotic Novelties, Penetrating Mini Clitoral Pump and related packaging, packaging copyright 2004; image produced Nov. 28, 2004.

California Exotic Novelties, Resonating Buttery and related packaging, packaging copyright 2006.

California Exotic Novelties, Selene vibrtaing clitoral pump and related packaging, packaging copyright 2005, 2011.

(56) References Cited

OTHER PUBLICATIONS

Lelo, Intima Celesse and related packaging, packaging copyight 2011.
Lelo, Nea and related packaging, packaging copyight 2011.
Lovehoney, Sqweel2 and related packaging, packaging copyright 2012.
Mina, Ola and related packaging; date unknown.
Nasswalk, Clit Cuddler and related packaging, packaging copyright 2006; image produced Feb. 2006.
Ohmibod, Club Vibe and related packaging; date unknown.
Ohmibod, Freestyle G and related packaging; date unknown.
Ohmibod, wireless music massager and related packaging; date unknown.
Pipedream, Vibrating Clit Sucker and related packaging, packaging copyright 2009.
Pipedream, Vibrating Clit Suck-Her and related packaging, packaging copyright 2008, 2010.
Diva, Diva Cup and related packaging; date unknown—packaging asserts 2003 product launch.
Doc Johnson, Lucid Dream Vibrator and related packaging, packaging copyight 2005.
Doc Johnson Pucker Up vibrating clitoral and vaginal pump and related packaging, packaging copyright 2004.
Durex, Funderwear article in Venture Beat online journal, Apr. 19, 2013.
Erostar, Allure vibrating clitoral pump and related packaging, packaging copyright 2001.
Good Vibes, Pucker Up vibrating pleasure pump and related packaging, packaging copyright 2010.
Hitachi, Magic Wand and related packaging; date unknown.
Intensity, device packaging; date unknown.
Je Joue, Ami and related packaging; date unknown.
Lelo, Ina and related packaging, packaging copyright 2012.

* cited by examiner

DEVICES AND METHODS FOR PROMOTING FEMALE SEXUAL WELLNESS

CROSS-REFERENCE

This application is a continuation of co-pending U.S. patent application Ser. No. 13/798,085, filed Mar. 13, 2013, titled "Device and Methods for Promoting Female Sexual Wellness" and claims the benefit of and priority to such application.

This application claims the benefit of and priority to: U.S. provisional application No. 61/729,231, filed Nov. 21, 2012, titled "Device and Methods for Promoting Female Sexual Wellness" and U.S. provisional application No. 61/731,487, filed Nov. 30, 2012, titled "Devices and Methods for Promoting Female Sexual Wellness," which applications are hereby incorporated herein, in their entirety, by reference.

FIELD OF THE INVENTION

Embodiments of the present invention relate generally to devices and methods and more particularly to promoting female sexual wellness and function. In particular, certain embodiments are useful for promoting, facilitating, stimulating, or enhancing sexual desire, arousal or satisfaction in a female.

BACKGROUND OF THE INVENTION

Clitoral vascular engorgement plays an important role in female sexual desire, arousal and satisfaction. Sexual arousal results in smooth muscle relaxation and arterial vasodilation within the clitoris. The resultant increase in blood flow leads to tumescence of the glans clitoris and increased sexual arousal. A variety of conditions may cause clitoral erectile insufficiency and reduced clitoral arterial flow. This, in turn, may lead to difficulty or inability to achieve clitoral tumescence. Female sexual wellness may also be negatively affected by a lack of subjective excitement, genital lubrication or orgasmic function.

The incidence of symptoms ranging from dissatisfaction to dysfunction is high in women. For example, in the National Health and Social Life Survey of 1,749 women age 18-59, 43% experienced sexual. Further, female sexual dysfunction is altered with aging, is progressive and highly prevalent affecting 30-50% of women and 68 to 75% of women experience sexual dissatisfaction or "problems" (not dysfunctional in nature). In a national survey of more than 31,000 women in the United States, 44.2% of women reported experiencing a sexual problem. According to other studies, over 53 million women (43% of the U.S. population) have reported one or more sexual problems and over 14 million women meet the clinical criteria for Female Sexual Dysfunction (FSD), with low desire being by far the most common problem (reported by 46 million women). (See, e.g., Spector I, Carey M. Incidence and prevalence of the sexual dysfunctions: a critical review of the empirical literature. 19: 389-408, 1990; Rosen R C, Taylor J F, Leiblum S R, et al: Prevalence of sexual dysfunction in women: results of a survey study of 329 women in an outpatient gynecological clinic. J. Sex. Mar. Ther. 19:171-188, 1993; Read S, King M, Watson J: Sexual dysfunction in primary medical care: prevalence, characteristics and detection by the general practitioner. J. Public Health Med. 19:387-391, 1997; Laumann E, Paik A, Rosen R. Sexual Dysfunction in the United States Prevalance and Predictors. JAMA, 1, 281: 537-544; Read S, King M, Watson J. Sexual dysfunction in primary medical care: prevalence, characteristics and detection by the general practitioner. J Public Health Med. 1997; 19:387-91; Schein M, Zyzanski S J, Levine S, Medalie J H, Dickman R L, Alemagno S A. The frequency of sexual problems among family practice patients. Fam Pract Res J. 1988; 7:122-34; Shifren J L, Monz B U, Russo P A, Segreti A, Johannes C B. Sexual problems and distress in United States women: prevalence and correlates. Obstet Gynecol. 2008; 112(5):970-978; and Shifren, Obstet Gynecol 2008; 112: 970-8. Each of these publications is incorporated by reference herein.)

Research indicates that a sufficient blood supply is required for good clitoral and vaginal function and satisfying sexual experience at any age. Women at risk for Female Sexual Dysfunction include those using birth control pills, those with poor vascular health (such as those with diabetes, high cholesterol, or hypertension), aging women and those undergoing or having undergone cancer radiation treatment (which may adversely decrease lubrication, hormone levels, and/or genital sensation). Using birth control pills can lower the circulating levels of testosterone needed to regulate blood flow to genitals and stimulate sexual desire and can cause long-term permanent sex hormone insufficiency. Also, the prevalence of sexual problems increases dramatically by age, with 27.2% of women aged 18 to 44 years, 44.6% of women aged 45 to 64 years, and 80.1% of women aged 65 years and older reporting sexual problems.

While the majority of male and female sexual organ is similar, a subtle anatomical difference makes females more susceptible to inhibitors. While the glans penis in men and the glans clitoris in women similarly each have the highest concentration of sensory receptors than any other location in the body, the male anatomy provides more extensive structural support for the glans penis. Addressing male sexual dysfunction can take advantage of this structural support by augmenting or enhancing the venous trapping function of the corpus cavernosum. In contrast, no anatomical sustain mechanism exists in women for engorgement making women more susceptible to an array of powerful inhibitors. While the female corpus canvernosum does become engorged during stimulation (see FIG. 29), it does not sustain engorgement to the same degree as the male anatomy.

FIG. 30 illustrates the variety of factors that can act as inhibitors or promoters of sufficient sexual stimulation. For example, FIG. 30 illustrates how sensory and psychosocial factors, such as the well-being of the woman's relationship with her partner and emotional or visual cues, drive central nervous system (CNS) mediated promotion or inhibition (denoted by the +/− symbol). Other health factors such as diabetes or cardiovascular disease or factors such as drugs can drive other inhibition or promotion. This multifactorial web has made developing a safe drug for treating women very challenging.

The female sexual response cycle affects the incidence of a satisfying sexual experience (SSE) for women. The cycle includes the states of (i) emotional and physical satisfaction, leading to (ii) emotional intimacy, leading to (iii) being receptive to sexual stimuli, leading to (iv) sexual arousal, leading to (v) arousal and sexual desire, which takes the cycle back around to the state of (i) emotional and physical satisfaction. Spontaneous sex drive can occur between states (ii) and (iii), between states (iii) and (iv), and/or between states (iv) and (v).

These and other challenges can be addressed by embodiments of the present invention.

BRIEF SUMMARY OF THE INVENTION

Certain embodiments of the present invention are related to a device, a system, or a method for promoting female sexual arousal.

Certain embodiments of the present invention are related to a device, a system, or a method for clitoral engorgement using suction combined with vibratory stimulation.

Certain embodiments of the present invention are related to a device, a system, or a method for providing variable and customizable control of vibration and suction.

Certain embodiments of the present invention are related to a device, a system, or a method for providing a novel power-tissue optimization scheme based on stimulators mounted on a flexible membrane Certain embodiments of the present invention are related to a device, a system, or a method for providing a novel suction attachment modality combined with multi-focal actuators.

Certain embodiments of the present invention are related to a device, a system, or a method for providing novel actuators for mechanical motion and suction.

DETAILED DESCRIPTION OF THE INVENTION

Figure 1A:
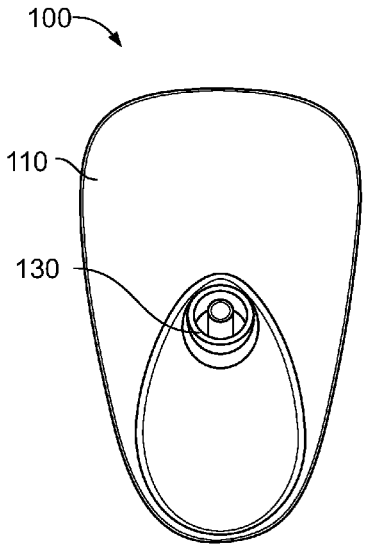
FIGS. 1A through 1D illustrate various views of a device according to an embodiment of the invention.
Figure 1B:
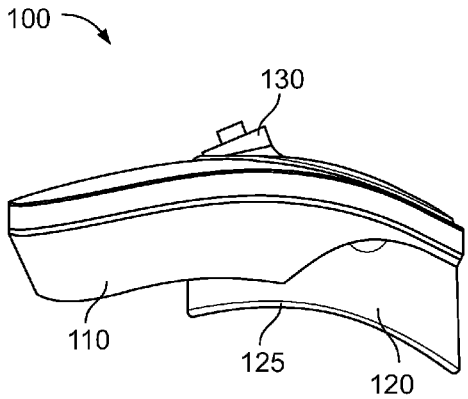
Figure 1C:
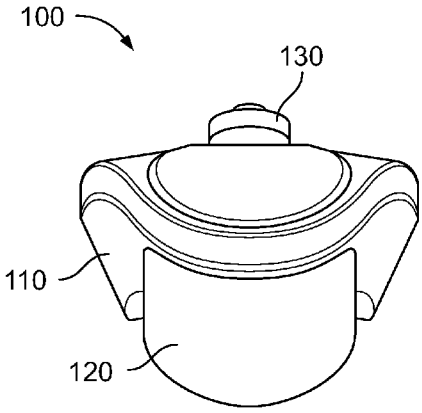
Figure 1D:
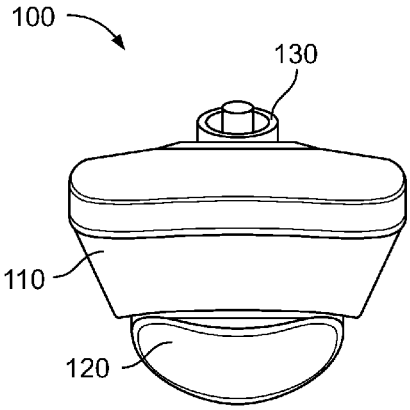
Figure 2A:
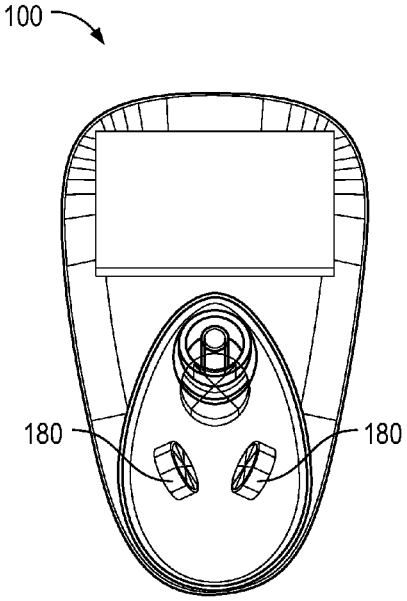
FIGS. 2A through 2D illustrate various views of the interior components of a device according to an embodiment of the invention.
Figure 2B:
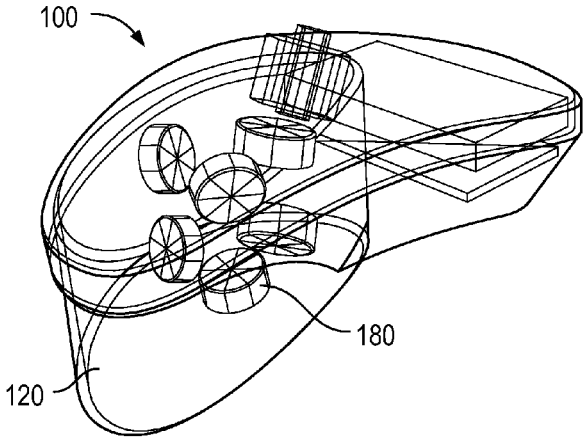
Figure 2C:
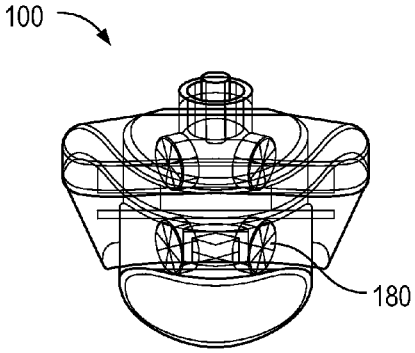
Figure 2D:
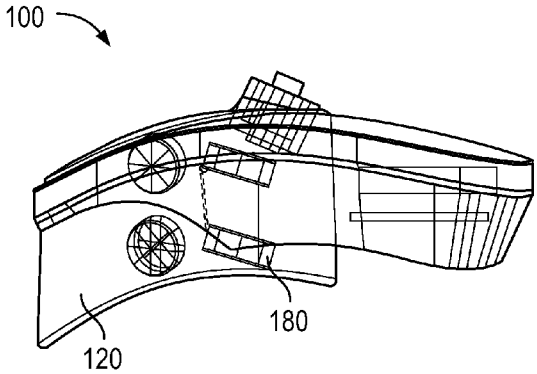

Embodiments of the present invention described herein, including the figures and examples, are useful for promoting female sexual wellness and function.

Before the present devices and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

Short summaries of certain terms are presented in the description of the invention. Each term is further explained and exemplified throughout the description, figures, and examples. Any interpretation of the terms in this description should take into account the full description, figures, and examples presented herein.

The singular terms "a," "an," and "the" include plural referents unless the context clearly dictates otherwise. Thus, for example, reference to an object can include multiple objects unless the context clearly dictates otherwise. Similarly, references to multiple objects can include a single object unless the context clearly dictates otherwise.

The terms "substantially," "substantial," and the like refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

The term "about" refers to a value, amount, or degree that is approximate or near the reference value. The extent of variation from the reference value encompassed by the term "about" is that which is typical for the tolerance levels or measurement conditions.

The term "stimulator" refers to elements that provide stimulation using mechanical motion (such as vibration), electrical stimulation, temperature, or other sensory stimulation.

Certain biological molecules and anatomical structures exist in a healthy female to create engorgement of the vulvar and clitoris erectile tissues. These molecules and structures facilitate stiffening the underlying stratum upon which the nerves in the clitoris are deployed. The effect of the stiffening is to allow for the more rigid projection and presentation of the clitoral structures for stimulation, as well as mechanically allowing energy waves to be propagated across the surface more efficiently with less energy absorption by the tissues. As a result, a rigid clitoris stimulated mechanically via deflection, vibration, and the like propagates these forces across the tensed surface of the structure rather than being lost within the loose connective tissue. Thus, means for producing an engorged environment (via drugs or via suction, for example) can enhance sensation and produce other reflexive responses (e.g., lubrication and oxytocin release). Further, the type and distribution of sensory nerve endings within the tissues of the clitoris and surrounding tissue explain why certain motions, pressures, vibrations, and other stimuli more optimally deliver pleasurable sensations than others. Vibration and suction both have the capacity to stimulate engorgement via the nitrous oxide pathway and thus both can increase sensitivity to sexual stimulation. The two follow different neuronal/physiologic pathways. Dual-triggering with the use of vibration and suction combined provide additive effects. Pacinian or pacini corpusles also called Vater-pacini receptors conduct signals in response to vibratory "pressure" (tissue vibration is conducted via a pressure wave)—the reflex responses utilize NOS pathways which deploy into the same structures that are engorged in the embodiments of the suction elements described herein. Motion/slippage in a repetitive pattern also produces a "pressure" pattern and vibratory nerve signaling. Nerves can adapt to stimuli quickly, thus vibration in one spot will typically become less impactful, therefore moving the site of vibration is beneficial, whether manually or automatically. All of the above are mediated by DH testosterone and other hormonal components (and thus testosterone therapy can help improve the quality of the tissues as well as their "activity") but we have discovered through mechanical stimulation—either through suction or vibration or both—many of the hormonal pathways can be bypassed and the reflex responses can be triggered directly.

Figure 31A:
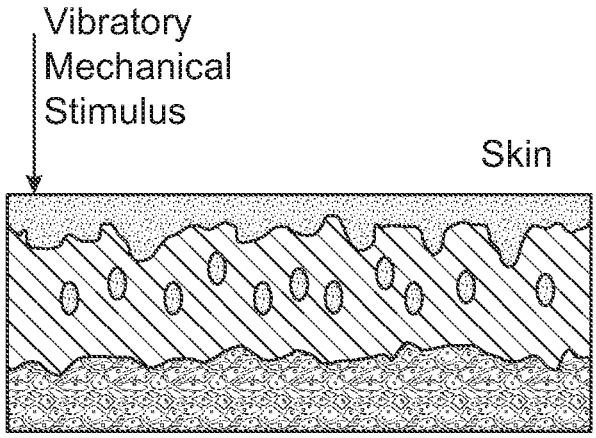
FIGS. 31A through 31C illustrate the relationship between engorgement and vibration propagation.
Figure 31B:
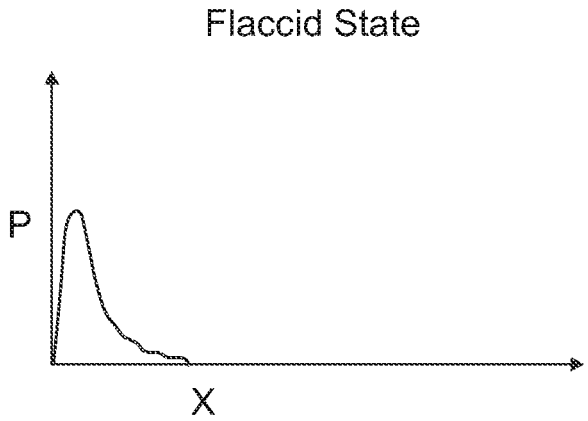
Figure 31C:
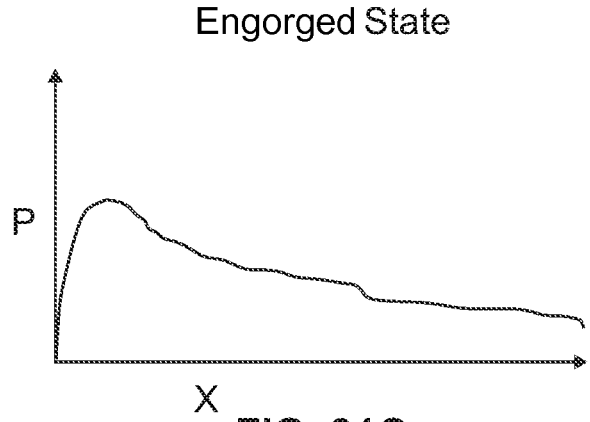

We have discovered that engorgement and vibration together are a powerful combination such that engorgement creates a more suitable mechanical back-board for the pacinian corpusles to be stimulated and that applying both simultaneously should produce more profound effects than either applied alone. In both sexes, engorgement of the sexual organs is the key physiological target in that engorgement is fundamental to achieve an SSE. As illustrated in FIGS. 31A through 31C, vibrational energy propagates better along a tensioned, engorged substrate. Embodiments described herein provide methods and devices for engorging sexual organs to better propagate vibrational energy.

Certain prior art stimulation devices, such as vibrators, provide relatively diffuse stimuli. That is, the vibrating motion supplied by a vibrator is applied relatively evenly over the clitoris and surrounding tissue. In certain vibrating devices that are capable of delivering vibration over a more tightly focused area, the frequency and magnitude of the vibration may still present a relatively diffuse vibratory motion to clitoral tissue. Additionally, much of the vibration of prior art vibrators is lost in vibrating the handle, housing and the user's hand or other portion of their body.

Advantageously, certain embodiments described herein are capable of providing complex patterns of suction. Such complex suction waveforms can provide a comparatively organic stimulation experience as compared to prior art mechanical stimulation devices. For some users, the variable suction patterns, algorithms waveforms of certain embodiments can provide engorgement and stimulation such that effective arousal is achieved without the use of vibration.

Advantageously, and in contrast to prior art devices, embodiments described herein are capable of providing spatially-differentiated vibratory motion. That is, a woman experiences spatially-differentiated vibratory motion. In certain embodiments, such spatially-differentiated vibratory motion may simulate an experience of macroscopic motion about the clitoris. Macroscopic motion can be understood as analogous to stroking motion, lingual motion, or motion consistent with intercourse. For some users, the spatially-differentiated vibratory motion of certain embodiments can provide engorgement and stimulation such that effective arousal is achieved without the use of suction. For some users, the macroscopic motion about the clitoris of certain embodiments can provide engorgement and stimulation such that effective arousal is achieved without the use of suction.

An aspect of spatially-differentiated stimulation is the isolation of the stimulation generated by a stimulator(s) from the stimulation generated by another, nearby stimulator. By isolating the stimulation generated by one motor from another, a device simulates and/or mimics macroscopic motion about the clitoris. Another aspect of spatially-differentiated stimulation is isolation of the stimulation generated by a stimulator(s) from the housing which minimizes loss of stimulation and allows the stimulation to be focused on the tissue of interest.

A further benefit of isolating vibration in devices according to embodiments disclosed herein, is that a small device may be discreetly worn which produces little noise while a focused, isolated vibration is applied and clitoral tissue is engorged.

Certain embodiments of devices disclosed herein use suction to draw tissue into contact with vibrating elements. Certain devices remain in contact with tissue by virtue of the suction applied to the tissue. Yet another benefit of isolating vibration in devices is that the airtight seal between the device and tissue is not substantially disrupted by the vibration. This type of vibration isolation involves substantially isolating the sealing elements of the device from the vibrating elements in the device.

The compact size of devices disclosed herein makes them capable of being discreetly worn and capable of being carried in a purse. Yet, devices disclosed herein are sized and configured to be accessible and controllable while being worn. Devices disclosed herein may be usable prior to and during intercourse or as a program for recruitment of blood flow and nerve sensitization of tissue. Devices disclosed herein may be adjustable and customizable and provide selectable, variable suction and vibrational properties. Devices disclosed herein may be capable of being controlled remotely, such as by a smartphone. Devices discloses herein may be capable of promoting and/or sustaining female sexual arousal.

Advantageously, devices disclosed herein use relatively low power motors to produce focused, spatially-differentiated vibration.

According to certain embodiments, the device has some or all of the following characteristics: (i) has a suitable fit; (ii) provides appropriate stimulation; (ii) is sufficiently comfortable or tolerable; and (iv) performs reliably and safely.

Regarding suitable fit, the following attributes may be present in a device having a suitable fit: (i) the device is wearable while ambulatory without the need for a tether or additional garment; (ii) the device is sized such that the attachment area fits between the labia majora inferior to the clitoris and the housing may exit the labia majora superior to the clitoris; (iii) the device continues to fit throughout the engorgement process; and (iv) the device is wearable during sexual intercourse. Further, the device can be configured such that placement of a portion of the device posterior of the labia majora is sufficient to securely hold the device in place, with or without additional suction.

According to certain embodiments, suitable fit can be achieved by providing some or all of the following parameters: (i) the device design and center of gravity allow the device to hold to the tissue for at least 5 minutes without a tether; (ii) the device may be worn under clothing; (iii) the mass of the device allows for attachment by suction only; (iv) the device stay in place for at least 5 minutes without adjustment; (v) the device has a compliant tissue interface region; (vi) the device stays in place while standing and walking while wearing the device; (vii) the footprint of device attachment area is anatomically appropriate; (viii) the device is designed to fit over at least a woman's clitoral region; (ix) the device provides space for the tissue to expand; (x) the external device envelope allows for discreet use; (xi) the device is designed such it does not occlude or limit access to the vaginal opening; (xii) the device body can withstand a force compressing it against a soft surface, such as a body; (xiii) the device height does not limit interaction of partners and the edge geometry is comfortable for both partners.

In certain embodiments, proper placement can be achieved by activating one or more motors to a detectable level of vibration to allow the user to center the stimulatory effect about the clitoris. By pre-activating the motors during placement, the user can customize the fit and determine the most effective location for vibrational simulation and/or suction stimulation.

Regarding appropriate stimulation, one or more of the following attributes can be present in a device providing appropriate stimulation: (i) the device applies suction to the vulvar region or more specifically the clitoral region to facilitate engorgement of the clitoral tissues; (ii) the device is capable of applying vibrational energy to at least the region of clitoral tissues; and (iii) the device provides stimulation for a sufficient period of time to achieve the desired degree of arousal.

According to certain embodiments, appropriate stimulation may be achieved by providing some or all of the following parameters: (i) the device provides suction to the clitoral region in a range of about 0.7 in Hg to about 9 in Hg; (ii) the device provides suction with the optional addition of personal lubricant in an environment in which pubic hair is present; (iii) the device maintains the selected level of suction for a minimum of 5 minutes; (iv) the user can control the level and pattern of suction including via use of wireless remote control; (v) the device generates vibration within the frequency range of 100-300 Hz; (vi) the vibrational forces (peak to peak) under load promote arousal; (vii) the vibratory elements are held in direct contact with tissue when suction is applied; (viii) the device provides full power stimulation for a minimum of 30 minutes on a single battery charge; and (ix) the device is capable of moving the vibration between sources as directed by the user.

Regarding comfort and tolerability, one or more of the following attributes may be present in a device that is sufficiently comfortable and tolerable: (i) the device allows for the user to release suction when desired; (ii) the device does not produce excessive noise; (iii) the device does not cause irritation of the urethra; and (iv) the device is comfortable to wear, with tissue contact surfaces that are soft and pliable and/or smooth with no protrusions.

According to certain embodiments, sufficient comfort and tolerability may be achieved by providing some or all of the following parameters: (i) the user can release the suction within 5 seconds when desired; (ii) the device does not produce sound that exceeds 70 dB, as measured at a distance of 2 inches from the outside of the shell when attached to the user; and (iii) the device fits over a woman's vulvar or clitoral region without occluding the urethral opening.

Regarding reliable and safe performance, the following attributes may be present in a device that performs safely and reliably: (i) the device does not pose a hazard of electrical shock; and (ii) the device allows for proper cleaning or disposal after each use.

According to certain embodiments, reliable and safe performance may be achieved by providing some or all of the following parameters: (i) the battery and electronics compartment(s) isolated from incidental contact with fluids; (ii) the maximum discharge rate of battery is not considered hazardous; (iii) the device life may be rated at 2-3 years; (iv) the stimulators are rated for at least sufficient use; (v) the device is water resistant when cleaned as recommended; and (vi) the device protects regions from contact with tissue/fluids or allows access to region behind the tissue interface for cleaning.

Certain embodiments have some or all of the following features: (i) the user is able to customize the suction and vibratory stimulation to suit their needs; (ii) the device withstands stresses of normal use; and (iii) the device may not have any user-replaceable parts.

Specific aspects of the device features may include some or all of the following: (i) the user is able to set suction to the level that is comfortable to them; (ii) the user is able to detach the suction tube from the device without losing vacuum pressure that leads to device detachment; (iii) the user is able to control vibration function by means of wireless remote control; (iv) the user interface is via iOS, Android, or other mobile operating system application on a Bluetooth enabled device or via an RF or Bluetooth key fob styled controller; (v) the user is able to control vibration parameters such as pattern transition speed and vibration amplitude; (vi) power is provided via an internal rechargeable battery, not accessible to the user; (vii) the user is able to control/direct vibration focus through pointing with finger on a wireless enabled device; (viii) the user is able to control degree of motor overlap; (ix) the motor overlap optimized for organic feel; (x) the device is enabled with basic rotational motor patterns; (xi) the device withstands an external force applied to the external shell (over the attachment area) by the user; (xii) the shell withstands sufficient vacuum cycles without loss of integrity; (xiii) the user is able to customize the motor pattern including direction, motor selection, looping, and save/recall the customized pattern; and (xiv) the user is able to customize the suction pattern and save/recall the customized pattern. Studies have shown that different areas of the female brain are activated when the clitoris is self-stimulated than when the clitoris is stimulated by a partner and that often times a female can achieve orgasm easier through self-stimulation than when stimulated by a partner. With the certain embodiments of the devices described herein, the female can record the stimulation pattern that allows her to achieve orgasm through self-stimulation and store it in the devices memory. Subsequently, the device can be used during intercourse to play the saved pattern such that the female can achieve orgasm as if she were self-stimulating.

Preferred attributes of certain embodiments include: (i) user adjustable suction for fixation and blood flow recruitment; (ii) user adjustable vibration for blood flow recruitment and nerve stimulation; (iii) spatially differentiated stimulation via macro-motion or isolation & control of multiple stimulation sources; (iv) tether-less and wearable during intercourse; and (v) customizable & reusable.

One embodiment of a device includes: (i) a shell that houses a circuit and battery and connects to suction zone; (ii) compliant wings to improve attachment; (iii) multiple stimulators attached to inner walls of compliant suction zone; (iv) motors isolated from outer shell to minimize damping and non-specific vibration; and (v) suction applied from removable applicator causes walls to move inward improving tissue contact.

In one embodiment of the device, a receptacle is coupled to a squeeze bulb for providing suction to the receptacle. The squeeze bulb can be integral to the housing or it may be removable. The receptacle is coupled to adhesive wings capable of conforming to interact with tissue. The wings are designed to conform to the anatomy and may include, for example, a butterfly-like shape. The wings may help stabilize the device and maintain contact with the device in the relevant anatomy. The edges of the wings and of the tissue contacting surfaces of the device are soft or radiused or both.

Certain embodiments of the device include on-board circuitry, power, or other electronic features. For example, the device includes an antenna for interacting with the remote controller, such as an RF antenna. The device includes a battery.

Certain embodiments of the device are controlled by a remote drive connected via drive cable to vibratory and/or suction elements inside the wearable part of the device.

Certain embodiments of the invention provide mechanical motion, preferably macroscopic motion, to simulate the motions naturally used by women to stimulate the clitoris in contrast to high-frequency mechanical vibrations of certain prior art devices. Some embodiments provide multivariate stimulation of the clitoris via a stabilized platform. By mechanically stabilizing a platform, it is possible to create a broad array of stimulating effects directly against the target clitoral tissues. Such effects may be difficult to achieve on a non-mounted platform. Examples of macroscopic motions include a rotary motion, a linear stroking motion, a low frequency "thumping" motion, and combinations above. Such macroscopic motions may be combined with vibration, for example, simple vibration or multiple and/or complex waveform vibration.

Certain embodiments of the device provide variable suction. In such embodiments, the user may rapidly and easily adjust the suction levels. Further, in certain embodiments the variable suction is programmable such that the amount of suction applied by the device can vary according to a pattern. In some instances, the suction pattern is complementary to the vibration and/or macroscopic motion patterns. The device controller includes a means for controlling the suction patterns, pre-loaded suctions patterns, user-configurable suctions patterns, or combinations thereof. The device controller enables the user to selected pre-loaded combinations of a suction pattern, a vibrational pattern, and/or a macroscopic motion pattern and also enables the user to design and select customized combinations.

FIGS. 1A, 1B, 1C, and 1D illustrate different views of a device 100 according to one embodiment. Device body 110 is designed to comfortably and discreetly fit against the user's body while remaining accessible and controllable. Device body 110 may include on-board controller circuitry, such as a circuit board, as well as a user control pad. Alternately or additionally, device body 110 may include an antenna for communication with a remote control device. Device body 110 may include a power source, such as a battery. Device body 110 is coupled to suction chamber 120. Suction chamber 120 includes sealing edge 125, which is capable of providing a substantially airtight seal against tissue. Sealing edge 125 may be a flange having a wider width than is pictured in FIGS. 1A through 1D. Suction port 130 is in fluid communication with the interior of suction chamber 120 and provides a connection to a suction device (not pictured), which created negative pressure within suction chamber 120. Suction port 130 may also include a check valve or other one-way valve such that when negative pressure is applied to suction chamber 120 the check valve or other one-way valve prevents suction loss through the valve. Optionally, device body 110 may include an onboard pump system to provide the initial suction to suction chamber 120. Further, the onboard pump system may further include a pressure sensor to maintain a desired level of negative pressure within suction chamber 120 despite the presence of any leaks that may occur along sealing edge 125. Although not pictured in this embodiment, device 100 may include the stimulators or other stimulation features, or combinations thereof, described in other embodiments herein.

FIGS. 2A, 2B, 2C, and 2D illustrate different views of the device 100 according to one embodiment. These figures depict vibratory motors 180 arrayed within the interior of suction chamber 120. In certain embodiments, the vibratory motors 180 are miniature coin style motors, which have an eccentrically rotating mass that provides vibratory motion. Device 100 is designed such that the vibratory motors 180 engage tissue when tissue is drawn into suction chamber 120. Vibratory motors 180 can be embedded in the walls of suction chamber 120, or they may be otherwise mounted in connection with suction chamber 120. In certain embodiments, it is preferable to minimize the transfer of vibration from vibratory motors 182 to the housing of suction chamber 120. Preferably, the majority of the vibratory energy is transferred to the tissue contacting vibratory motors 180. Vibratory motors 180 may be vibrationally isolated from the rest of device 100 by using mounting mechanisms that inhibit the transfer of vibrational motion to the walls of suction chamber 120. As described herein, vibratory motors 180 may be individually addressable by the controller circuitry such that patterns of motion, and in particular simulations of macroscopic motion, can be applied to the tissue in contact with the vibratory motors.

Figure 25A:
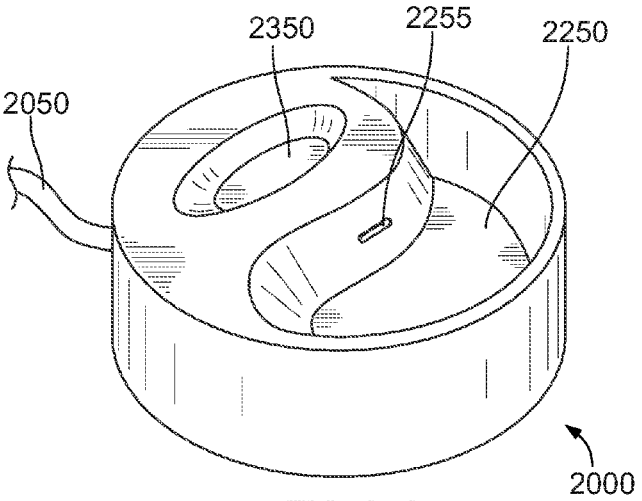
FIGS. 25A and 25B illustrate a charging station and device according to an embodiment of the invention.
Figure 25B:
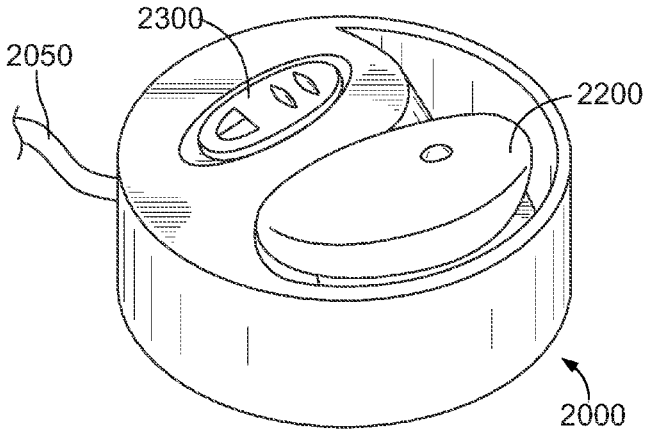
Figure 25C:
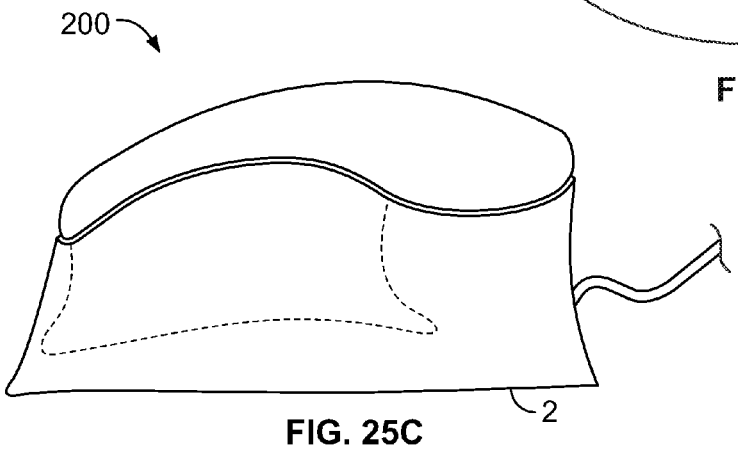
FIG. 25C illustrates a charging station and device according to another embodiment of the invention.

FIGS. 25A and 25B illustrate a charging station 2000 for a device 2200 and a key fob style controller 2300. Charging station 2000 can be plugged into an electrical outlet via cord 2050. Device 2200 can be placed inside device cavity 2250 and controller 2300 can be placed in controller cavity 2350. The walls of the cavities can have charging contact points, such as contact point 2255, for charging the device battery. Or, the battery of device 2200 can be charged by induction. Station 2000 can contain a comparatively high capacity battery that is charged via cord 2050 and is capable of holding charge and also recharging the comparatively smaller capacity battery in device 2200 when station 2000 is unplugged from an electrical outlet. Controller 2300 can be also be charged by the methods described herein or their equivalents. FIG. 25C depicts device 200 in charging cradle 2, which has the same attributes as the charging station depicted in FIGS. 25A and 25B. That is, cradle 2 is capable of charging device 200 by induction, contact points, or other means and contains a rechargeable battery capable of charging the battery within device 200.

Figure 3A:
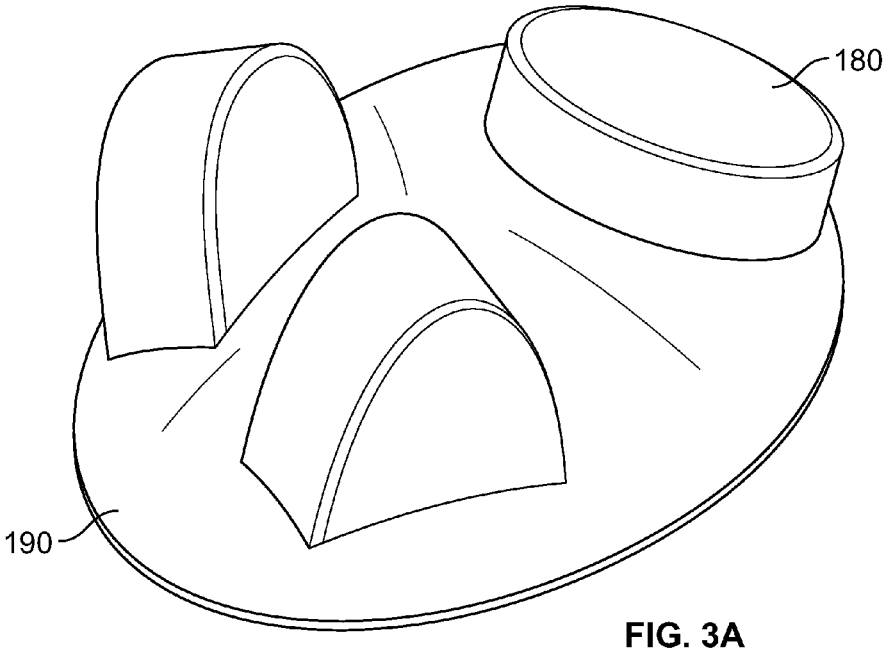
FIG. 3A illustrates a membrane according to an embodiment of the invention.

FIG. 3A illustrates three vibratory motors 180 encapsulated in a membrane 190. Membrane 190 is configured to be inserted within a suction chamber of a device. Membrane 190 provides a safe, comfortable, and reliable protective barrier around vibratory motors 180 within a suction chamber. The protective barrier helps reduce tissue irritation and provides a way to clean and reuse the device. As pictured in FIG. 3, membrane 190 has a convex shape, which defines an interior portion into which tissue is drawn. Membrane 190 has at least one, but preferably more than one holes, perforations, slits, or combinations thereof, to allow deformation of the membrane and airflow. During use when suction is applied through the suction port to the suction chamber tissue is drawn in to the suction chamber and against membrane 190. Membrane 190 deforms towards the interior of the suction chamber while maintaining intimate contact between vibratory motors 180 and tissue. FIG. 3A depicts two of the vibratory motors as being configured to be placed end on against tissue. Any number of the motor(s) can be used and any number may be configured to be placed on end.

Figure 3B:
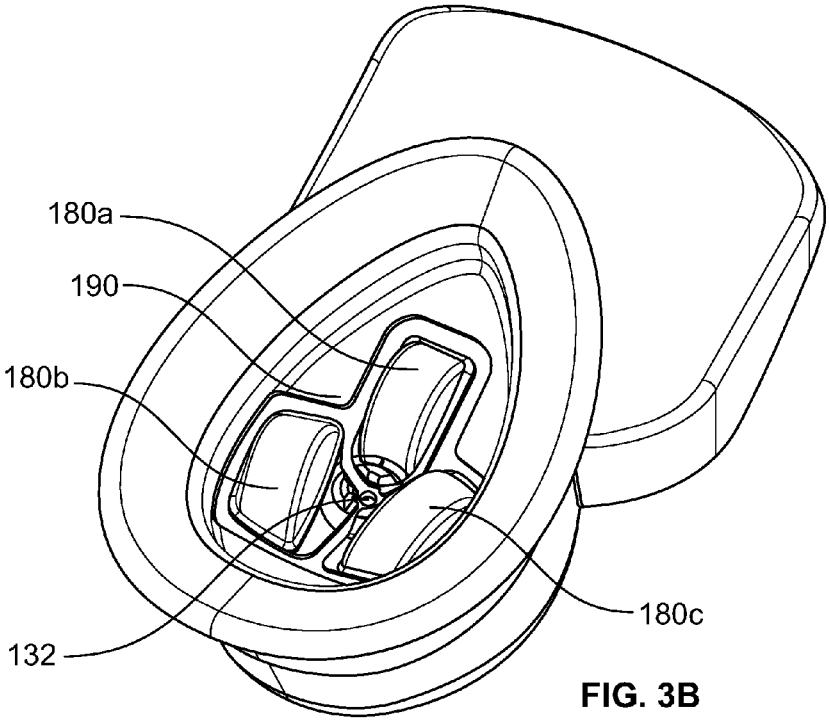
FIG. 3B illustrates a perspective view of the body-contacting side of a device according to an embodiment of the invention.
Figure 3C:
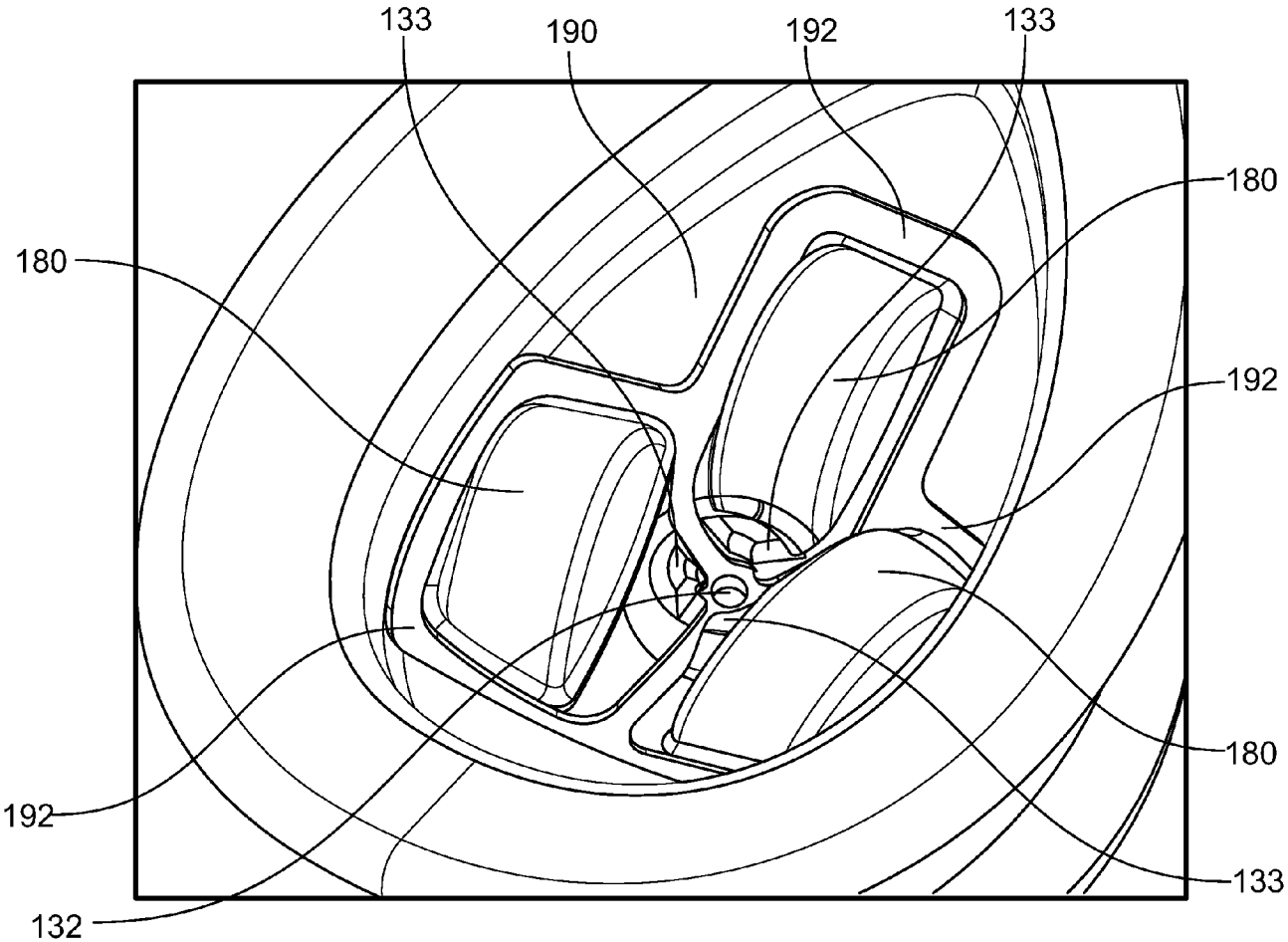
FIG. 3C illustrates a close-up perspective view of the body-contacting side of a device according to an embodiment of the invention.

FIG. 3B illustrates a perspective view of the tissue-contacting side of device 100 according to an embodiment. In this embodiment, vibratory motors 180 are spaced relatively close together and thereby form a cavity that is sized to approximate the volume of clitoral tissue to be engaged by the device. FIG. 3C illustrates a close-up view of clitoral tissue cavity. Suction inlet 132 is depicted at the approximate apex of the clitoral tissue cavity, but the inlet can be offset to one side rather than being at the apex. Further, suction inlet 132 can be physically offset from the clitoral tissue cavity by a permeable membrane, mesh, or other offset structure. In other words, a fabric or mesh screen can be placed over suction inlet 132 to prevent tissue from becoming trapped insider the suction inlet. For example, an expanded PTFE membrane can be used as the offset structure to provide and maintain a vacuum path between tissue and the suction inlet. FIG. 3C illustrates protrusions 133 as forming an offset structure. Still further, suction inlet 132 may be physically offset from the clitoral tissue cavity by a narrow channel that is too narrow for clitoral tissue to penetrate. Still further, suction inlet 132 can include multiple smaller diameter suction inlets recessed among protrusions. Such offset structures can be combined. Still further, the motors can be sufficiently prominent or protruding from the surface of the flexible membrane (while still being covered by the membrane) to function as offset structures that hold back tissue from blocking the suction inlet region. The offset structures function to prevent tissue from completely covering suction inlet 132, which could cause a drop in vacuum flow as well as damage or pain to tissue.

FIGS. 3B and 3C show the miniature coin-style vibratory motors 180 are deeply recessed into membrane 190 such that one third to one half of the motor extends beyond membrane 190 and toward tissue. Deeply recessing the motors places them closer to tissue and provides a deep clitoral tissue cavity. Close proximity to tissue and a deep clitoral tissue cavity can each provide higher stimulating forces as compared to shallowly recessed motors. It is advantageous to transmit as much force as possible from the motor to the tissue, particularly in the embodiments in which the device is maintained in contact with tissue by suction. In such embodiments, it is advantageous to transmit the force efficiently to tissue since the motors are relatively low power and force losses will dampen the stimulation effect.

FIGS. 3B and 3C depict channels 192 in membrane 190 that at least partially surround the recessed portion of vibratory motors 180. Channels 192 can be a thinned out portion of membrane 190 and can be part of the membrane mold or can be created by removing material from the membrane after molding. Channels 192 function to help provide and maintain a vacuum path between tissue and the suction inlet by providing a "leak path." As discussed above, it is preferable in certain embodiments to maintain a flow path to suction inlet 132. Channels 192 also function to isolate the vibration of a given motor from the rest of the membrane and the body of the device. Being thinner regions than the surrounding membrane, channels 192 can flex more and dampen vibrational energy that might otherwise be transmitted to the relatively thicker and less flexible parts of the membrane. Minimizing or eliminating vibrations in the membrane from being transmitted to the device body has the advantages of avoiding undesirable effects such as noise, discomfort, reduced stimulation, and reduced suction (by virtue of losing the seal provided by the sealing edge.

Figure 4A:
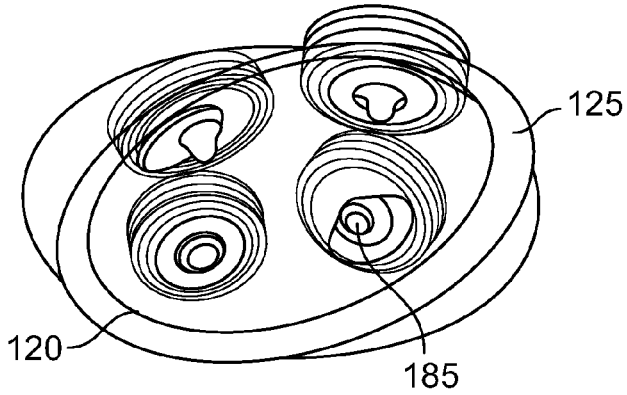
FIG. 4A illustrates a perspective view of the interior of a chamber portion and associated stimulators of a device according to an embodiment of the invention.
Figure 4B:
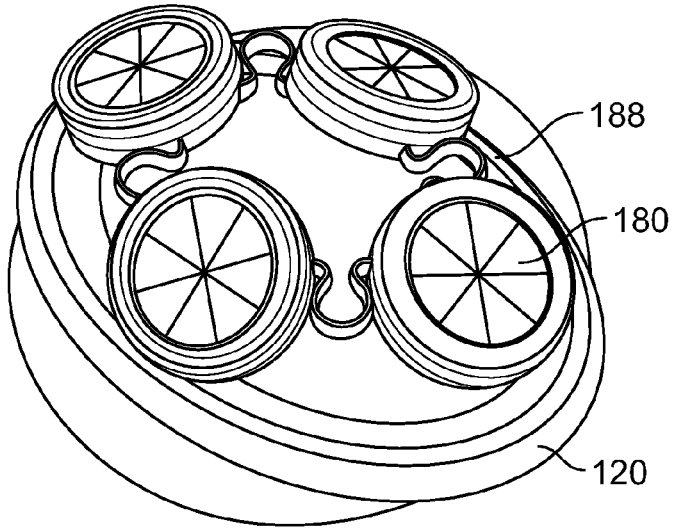
FIG. 4B illustrates a perspective view of the exterior of a chamber portion and associated stimulators of a device according to an embodiment of the invention.

FIGS. 4A and 4B illustrate views of a suction chamber 120 and vibratory motors 180 according to an embodiment. FIG. 4A depicts a view of the interior of suction chamber 120 and depicts stimulating features 185 coupled to vibratory motors 180. When tissue is drawn into suction chamber 120, stimulating features 185 transmit vibratory energy generated by vibratory motors 180 to the tissue. Stimulating features 185 may have a variety of shapes, textures, and configurations. Stimulating features 185 may be different in a single device and may be interchangeable, replaceable, and customizable. FIG. 4B depicts a view of the outer surface of suction chamber 120 and illustrates the arrangement of vibratory motors 180.

Figure 5A:
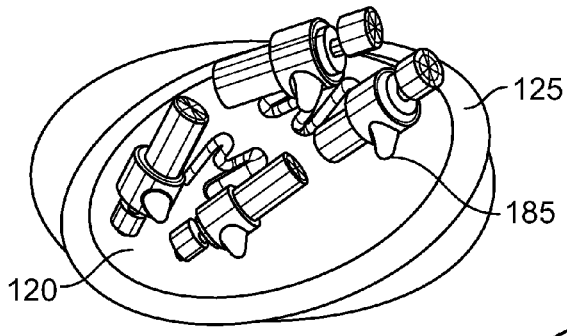
FIG. 5A illustrates a perspective view of the interior of a chamber portion and associated stimulators of a device according to an embodiment of the invention.
Figure 5B:
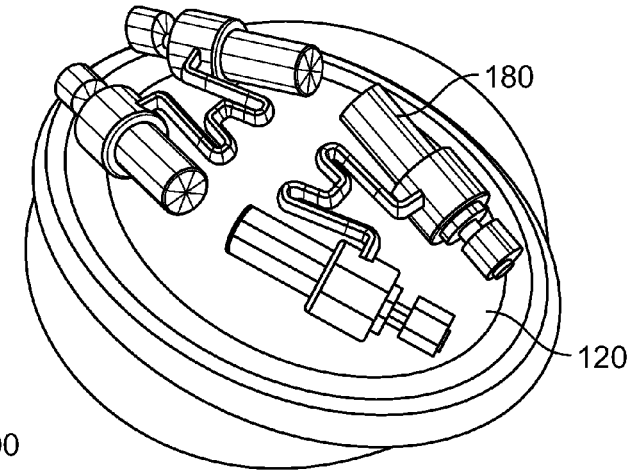
FIG. 5B illustrates a perspective view of the exterior of a chamber portion and associated stimulators of a device according to an embodiment of the invention.

FIGS. 5A and 5B illustrate the use of suction chamber 120 and miniature vibratory motors 180 according to an embodiment. In this embodiment, miniature vibratory motors 180 are cylindrical in contrast to the disk-like miniature coin-style motors. Vibratory motors 180 are coupled to stimulating features 185 to transmit vibratory energy to tissue.

Figure 6:
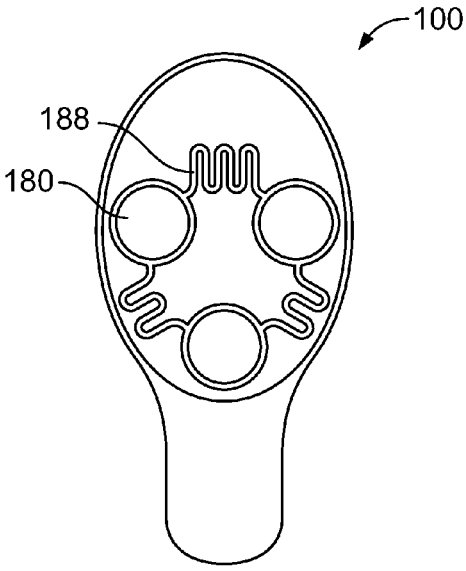
FIG. 6 illustrates stimulators and vibration isolators of a device according to an embodiment of the invention.

FIG. 6 illustrates a view of a device according to an embodiment. Stimulators 180 are spaced apart by isolating arms 188. Isolating arms 188 provide a sub-assembly in which stimulators 180 can be assembled. Isolating arms 188 function to isolate the vibrational energy of one stimulator from another stimulator. This is useful in circumstances where the stimulators are activated at different times and/or at different frequencies and/or at different amplitudes. By isolating the vibrational energy generated by one motor from the vibrational energy generated by another motor, it is possible to simulate macroscopic motion around or on tissue. FIG. 6 depicts one type of vibration isolation, but other types and their equivalents are within the scope of this disclosure.

Figure 7:
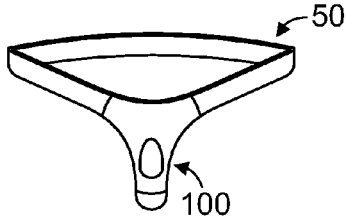
FIG. 7 illustrates a wearable garment and a device according to an embodiment of the invention.

FIG. 7 illustrates a view of the device 100 and an embodiment of a garment 50. In this embodiment, garment 50 is a simple strap or belt that connects to device 100 and helps maintain its position on the body of the user. In certain embodiments, garment 50 is optional as device 100 is configured to maintain its position on the body primarily via suction. However, it is understood that for some users an additional means of maintaining the position of device 100 may be desirable. Further, it is understood that device 100 may be configured to be attached or could be otherwise integral with other garments including lingerie or other women's intimate apparel. Jewelry with functional elements that stimulate other areas of the skin can be used to increase arousal. Such functional elements can be one or more of air blowing across the skin, stroking of a soft element, application of slight warming or cooling.

Figure 8A:
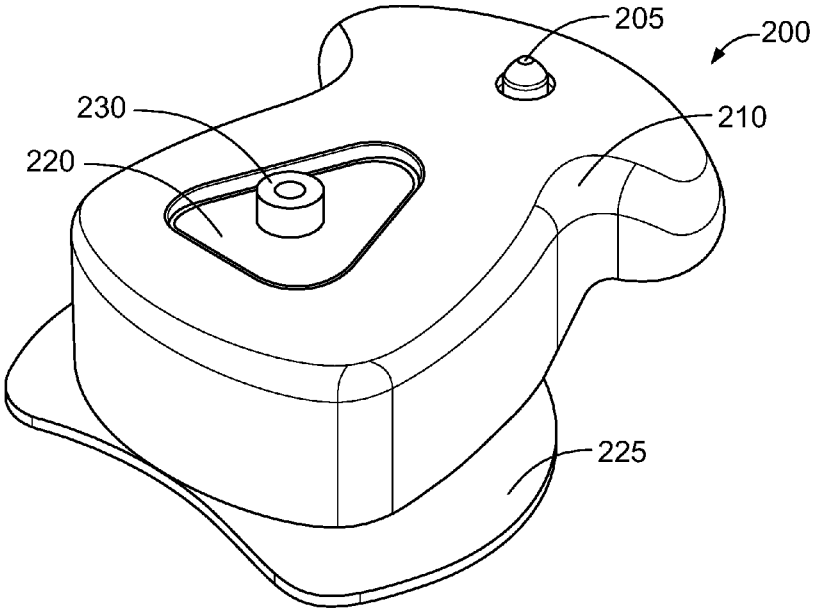
FIGS. 8A through 8C illustrate various views of a device according to an embodiment of the invention.
Figure 8B:
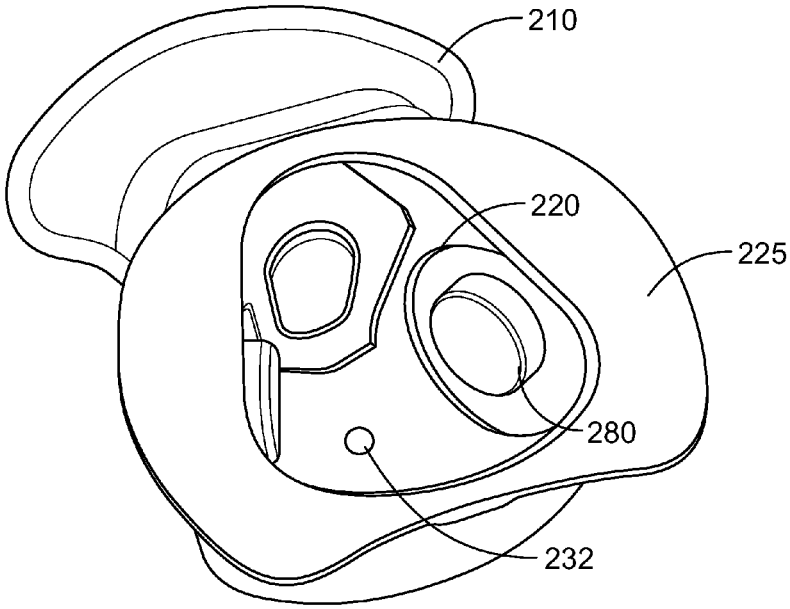
Figure 8C:
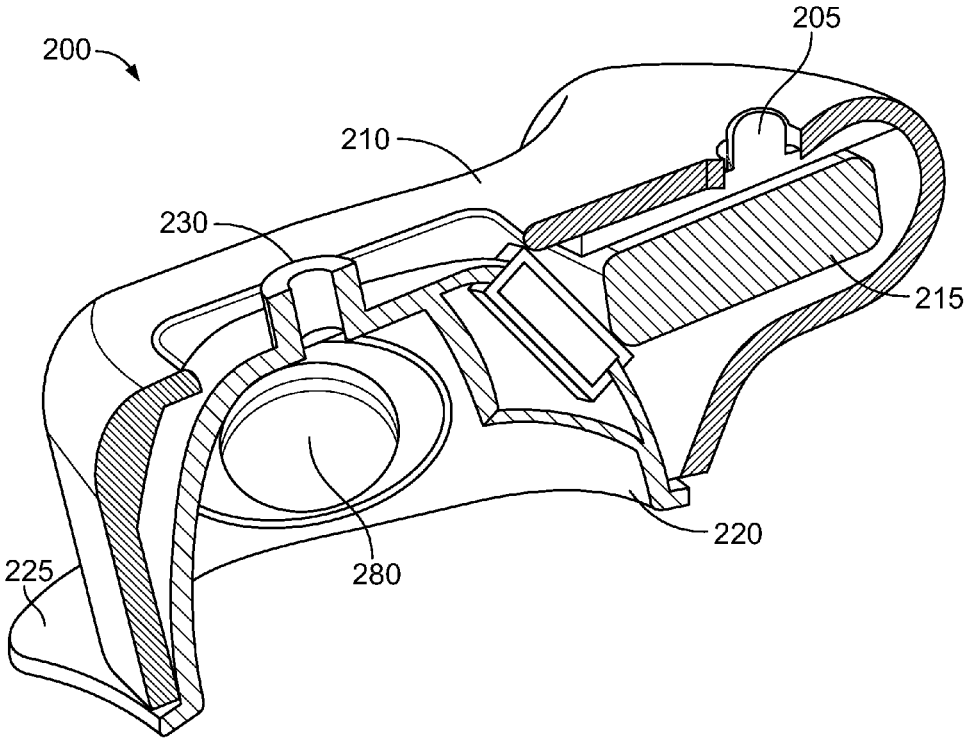
Figure 8A:
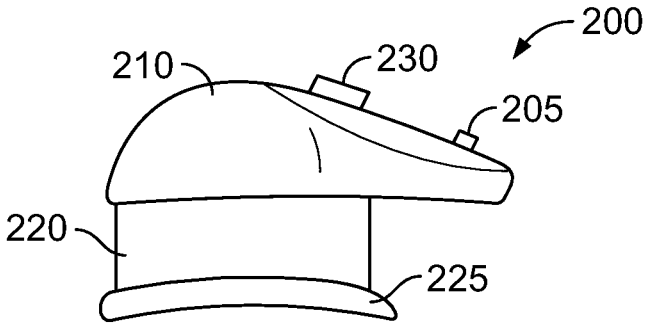
Figure 8B:
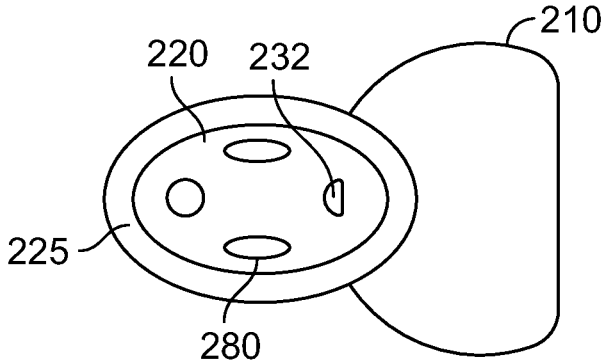
Figure 8C:
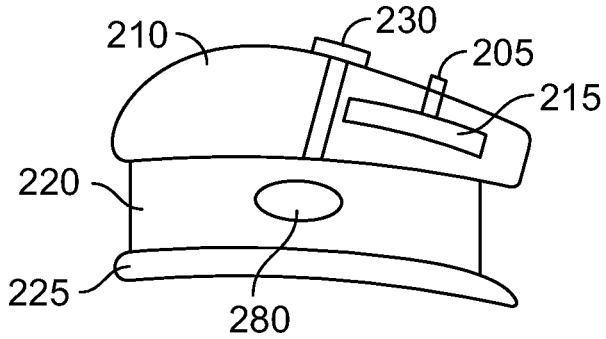

FIGS. 8A, 8A', 8B, 8B', 8C, and 8C' depict a device 200 according to an embodiment. Device body 210 includes suction chamber 220. Suction chamber 220 includes sealing edge 225, which is adapted to provide a substantially airtight seal against tissue. Suction port 230 provides fluid communication between the interior of suction port 220 and a suction device (not pictured). Device body 210 includes a user control area, which in this embodiment includes activation button 205. It is understood that the user control area may contain multiple control inputs. Further, the device 200 may be controlled remotely. FIGS. 8B and 8B' illustrate a bottom view of device 200 and depicts the interior of suction chamber 220. Multiple stimulators 280 are coupled to the inner walls of suction chamber 220. Suction inlet 232 includes a check valve or other one-way valve connecting suction port 232 to the interior of suction chamber 220. FIGS. 8C and 8C' depict a cutaway view of device 200 and illustrates, in addition to the features already described, controller block 215. Controller block 215 is electronically attached to the user control area and/or remotely controllable by a remote control device via an antenna. Device body 210 provides a safe, reliable, and comfortable protective barrier, which protects the electronics in controller block 215.

Suction ports can connect to suction devices using various types of fluid connectors, including but not limited to snap fittings, quick-release fittings, screw fittings, luer lock fittings, push-in fittings, magnetic couplers, and their equivalents.

Device body 210 includes a firm but flexible shell, which houses electronics and couples the electronics to suction chamber 220. Device body 210 may further include a charging port to recharge the power source included in controller block 215. Activation buttons present in the user control area may be recessed or otherwise made comfortable, safe, and reliable. Sealing edge 225 may include soft, flexible, compliant material, such as silicone or closed cell polyurethane foam, and may optionally be mildly adhesive to tissue or may be adapted to contain an adhesive material. Device body 210 is configured such that the posterior, or underside, of device body 210 is in a different plane than sealing edge 225. This configuration allows device body 210 to ride over the pubic bone of the user and to optionally attach to a garment while sealing edge 225 is in contact with tissue.

FIGS. 24A, 24B, 24C, and 24D illustrate different views of device 200 according to another embodiment. Device 200 includes device body 210, which can house controller circuitry, and suction chamber 220. The controller circuitry can be accessed using an interface mounted on device body 210 and/or via a remote controller. The remote controller can be physically tethered to device body 210 or it can be wirelessly connected. Suction body 220 includes sealing edge 225, which is adapted to provide a substantially airtight seal against tissue. The various views of FIGS. 24A, 24B, 24C, and 24D illustrate certain features of the shape and form of device 200 which promote comfortable, discreet, and secure attachment of device 200. For example, device 200 is sized such that the attachment area, defined by area where sealing edge 225 meets suction chamber 220, fits between the labia majora inferior to the clitoris and device body 210 may exit the labia majora superior to the clitoris. Further, the taper of the upper section of suction chamber 220 facilitates comfortable, discreet, and secure fit. The curve of device body 210 can help device 200 conform to the user and allow discreet placement inside garments.

Specifically, the front section 225*f* of sealing edge 225 is placed superior to the clitoris and tucked under the anterior commissure of the labia majora. In that position, the labia majora inferior to the anterior commissure can snugly engage the tapered section 220*t* of suction chamber 220 such that substantially the entire front and lateral portions of the sealing edge 225 are tucked under the labia majora. Advantageously, the tapered section 220*t* of suction chamber 220 allows the labia majora to comfortably engage a comparatively narrower section of the device while vaginal tissue superior to the vaginal orifice engages the comparatively wider sealing edge 225.

In certain embodiments, multiple vibratory-disc, or miniature coin-style, motors are embedded in the wall of a flexible suction chamber. In certain embodiments, the motors are embedded in a flexible membrane, which is attached to the walls of the suction chamber. When suction is applied, tissue is brought into contact with the stimulator. The motors can be controlled by controller circuitry to produce one or more of the following patterns: (i) all on; (ii) clockwise; (iii) counter clockwise; (iv) up-down; (v) lateral; (vi) all pulse; (vii) selected motor pulse; (viii) gradients in frequency; and (ix) gradients in amplitude. The translation of the vibratory pattern and spatial isolation of the motors may produce a desired effect of simulating macroscopic motion without incorporation parts that actually move in macroscopic dimensions. Stiffening members may be added to the motor mounts to vary and/or isolate vibration. The inner surface of the membrane may be textured to transmit vibration to tissue. The flexible membrane reduces or eliminates the coupling of the motor vibration to the device housing and increases or maximizes energy delivery into the tissue.

In one embodiment depicted in FIG. 3B, patterns are created by three vibratory motors. For example, rotational patterns (clockwise or counter clockwise) are created by first activating motor 180*a* and then activating motor 180*b* and then activating motor 180*c*. After a motor is activated it can be completely deactivated or have its power reduced such that a pattern of higher power vibration rotates around the array of motors. As another example, a V pattern of vibration is created by simultaneously activating motors 180*a* and 180*b*, then deactivating both, and then simultaneously activating motors 180*a* and 180*c* and then deactivating both. The V pattern can then be repeated. As another example, a lateral pattern is created by alternating activation and deactivation of motors 180*b* and 180*c* while motor 180*a* remains deactivated. As another example, a lateral pattern is created by alternating activation and deactivation of motors 180*b* and 180*c* while motor 180*a* remains activated.

The patterns described above and equivalent patterns can be created by arrays with more than three motors. Rotational patterns, lateral patterns vertical patterns, and combination thereof can be created by selectively activating an deactivating motors. All such patterns are within the scope of the invention disclosed herein regardless of the number of motors. Further, in embodiments herein in which vibratory motors are depicted as providing the stimulation, other stimulators can be used in place of or in addition to the vibratory motors. That is, one or more of the vibratory motors can instead be an electrical stimulator, temperature stimulator, or other stimulator.

In certain embodiments, multiple vibratory motors create resonance. Resonant patterns may be advantageous because they may create unique vibratory patterns that would be difficult to achieve with a single vibrating source, and they may create amplification in vibratory power that exceeds the capability of a single motor. Such amplification may be useful in the case of certain electrical power or space constraints. Resonance created through the use of multiple vibratory sources may employ different sources including rotary motors, linear motors, and piezoelectrics. The combination of multiple sources may create a large range of customizable and selectable resonant patterns. Further, motors of different sizes and/or power can be used to create multiple resonant frequencies to amplify the vibration effect.

Multiple, isolated and independent motors may combine to produce resonant patterns and/or may simulate macroscopic motions. Transitions between motors are smoother with sine wave than square wave. Optimizing the timing and the amplitude of the motion during transition improves the "organic" feel of the stimulation. Preferably, multiple small motors are used to provide easily-differentiated stimulation and simulation of macroscopic motion. Small eccentric motors placed on edge provide a focused vibration point, which promotes differentiation among several vibration sources. Slower vibration transitions promote differentiation among several vibration sources as compared to more rapid transitions.

In certain embodiments, devices provide macroscopic motion in addition to, or instead of, simulating macroscopic motion.

Figure 9:
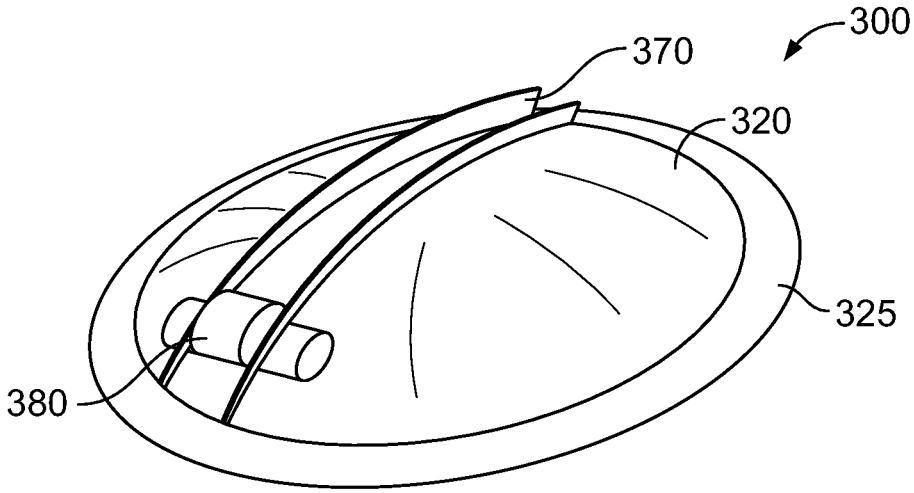
FIG. 9 illustrates a portion of a device configured to provide macroscopic motion according to an embodiment of the invention.

FIG. 9 depicts a device 300 that provides macroscopic motion according to an embodiment. Device 300 includes suction chamber 320 and sealing edge 325, which are both configured to engage tissue as described herein. In this embodiment suction chamber 320 is flexible and deformable such that motor 380 deforms suction chamber 320 as it traverses suction chamber 320 via rails 370. Motor 380 may be coupled to a cylinder or may itself be a cylinder, which rolls, slides, or otherwise moves along rails 370. The motion of motor 380 across suction chamber 320 simulates a stimulating stroking motion and promotes blood flow and/or clitoral engorgement. Suction chamber 320 includes a suction port (not pictured), which is used similar to suction ports described herein and includes a check valve or other one-way valve to maintain suction in the chamber. Motor 380 may vibrate in addition to traversing rails 370 and thereby provide both a stroking motion and a vibratory motion.

Figure 10:
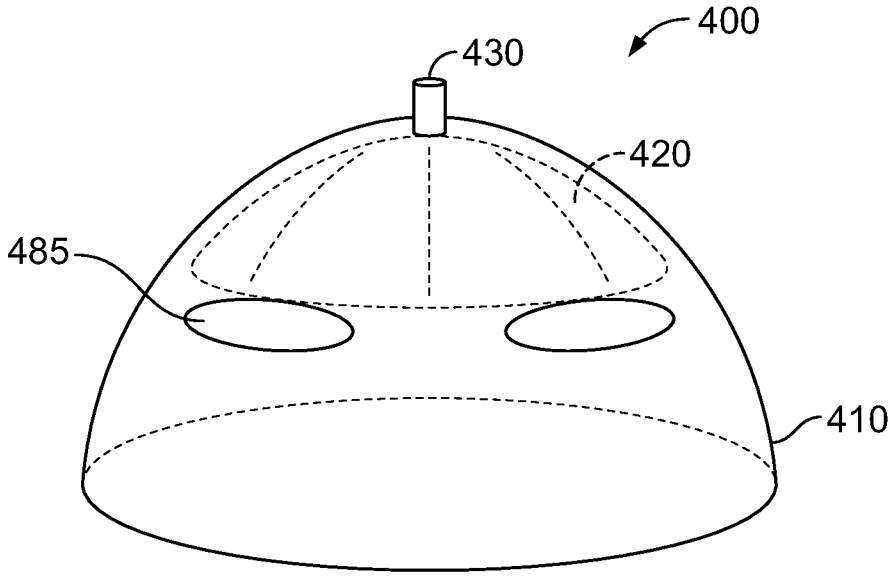
FIG. 10 illustrates a portion of a device configured to provide macroscopic motion according to another embodiment of the invention.

FIG. 10 depicts an embodiment of a device 400 providing macroscopic motion according to an embodiment. Device 400 includes device body 410 and dome 420. Dome 420 is configured to rotate with respect to device body 410 about an axis central to both device body 410 and dome 420. Stimulating features 485 are coupled to dome 420. Suction port 430 operates to provide suction to the interior of device body 410 to draw tissue into contact with stimulating features 485. A motor (not pictured) drives the rotation of dome 420 with respect to device body 410 and rotates stimulating features 485 about the clitoral tissue drawn into the interior of device body 410. Stimulating features 485 may also be driven by vibratory motors to provide both a stroking motion and a vibratory motion.

Alternately, the motion of the dome may be driven magnetically. For example, dome 420 may include a single offset magnet. Device body 410 may include several electromagnets, which are individually addressable by a controller. The motion of the dome can be driven by selectively charging each electromagnet in a sequence or pattern.

Figure 11:
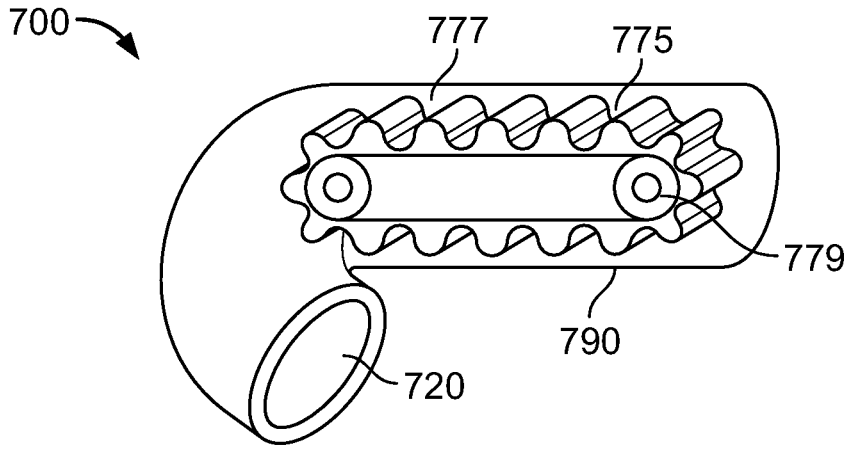
FIG. 11 illustrates a device configured to provide macroscopic motion according to an embodiment of the invention.

FIG. 11 depicts one embodiment of a device 700 in which a moving tread 775 under a stationary membrane 790 provides macroscopic motion for stimulation. The moving tread 775 is housed under a thin membrane 790, which is compliant and flexible and moves with features on the tread. The tread 790 has raised regions 777 spaced apart from each other at physiologically-relevant spacings. The tread rides on two or more rollers 779, at least one of which is powered to cause the tread to rotate.

Figure 12:
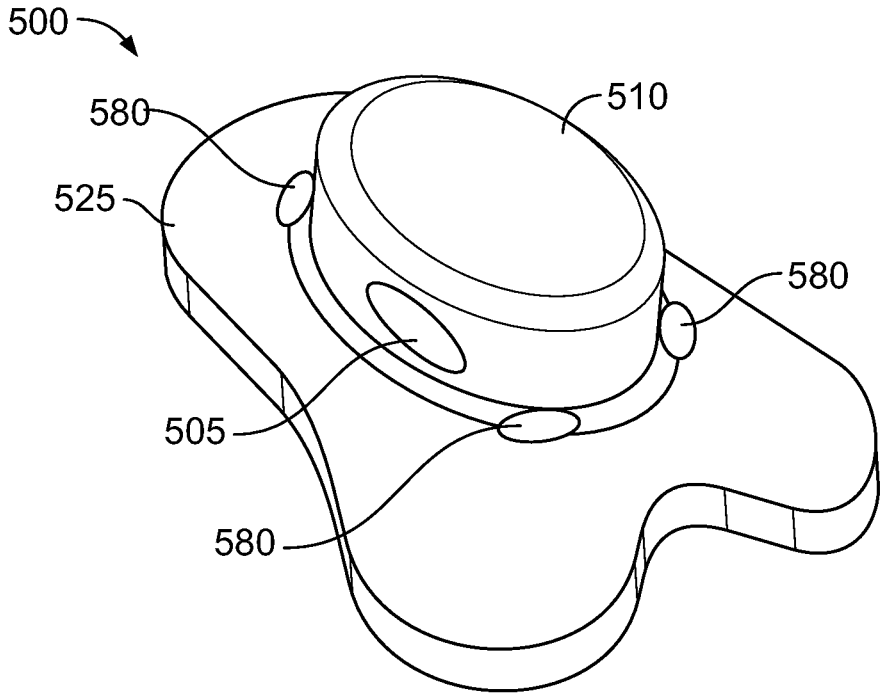
FIG. 12 illustrates a perspective view of a device according to another embodiment of the invention.

FIG. 12 illustrates a device 500 according to an embodiment. Device body 510 is attached to flange 525, which is configured to maintain a substantially airtight seal against tissue. The tissue-contacting surface of flange 525 may include a mild adhesive, and/or an adhesive substance may be applied to the tissue-contacting surface of flange 525. Optionally, a lubricant and/or an exothermic substance may be applied to the tissue-contacting surface of flange 525. Flange 525 is flexible and conformable and adapted to provide a reliable and comfortable anatomical fit. Device body 510 includes a suction chamber (not pictured) capable of drawing tissue into its interior. Device body 510 includes vibratory motors 580 capable of delivering spatially-isolated vibration to tissue. Device body 510 included activation button 505 in a user-accessible location, such as on the side of the exterior of the suction chamber.

Figure 13:
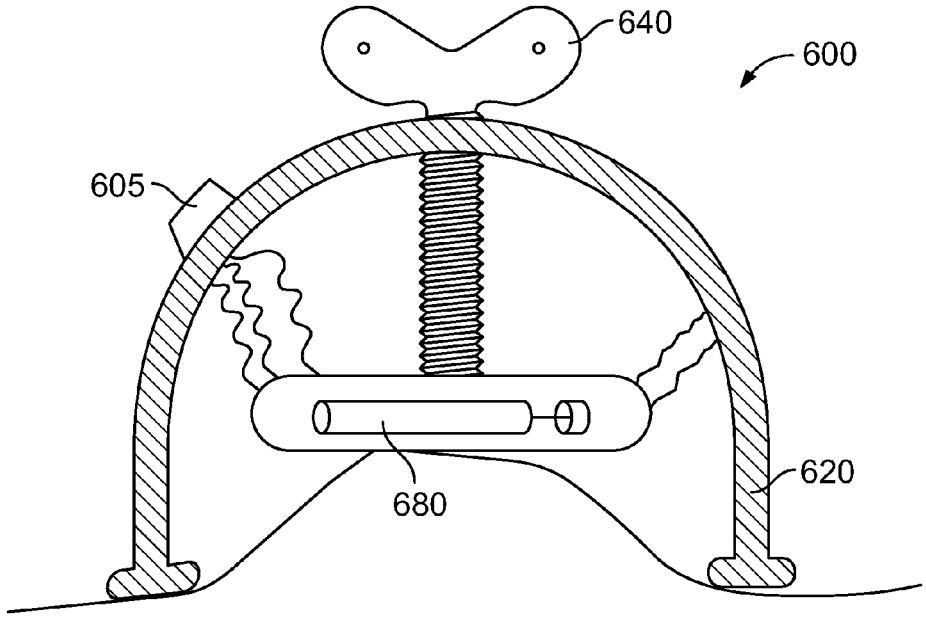
FIG. 13 illustrates a cross-sectional view of a device according to another embodiment of the invention.

FIG. 13 illustrates a device 600 according to an embodiment. Device 600 includes suction chamber 620, which is configured to apply suction to tissue through a suction port or other mechanism as described herein. Device 600 includes a stimulator 680 and power source such as a battery. Stimulator 680 is suspended from suction chamber 620 via an adjustment arm 640. Adjustment arm 640 allows a user to precisely and repeatably control the force of contact between stimulator 680 and tissue. Device 600 includes an activation button 605 and can include remote control capabilities via an onboard antenna. Alternately, the adjustment arm can be electronically controlled, such as by applying current through a nitinol arm to control the position of the motor relative to tissue.

Figure 14A:
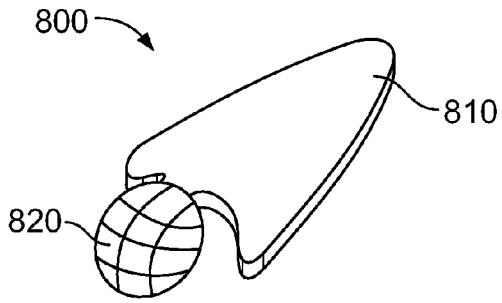
FIGS. 14A and 14B illustrate views of a device and assembly of such a device according to another embodiment of the invention.
Figure 14B:
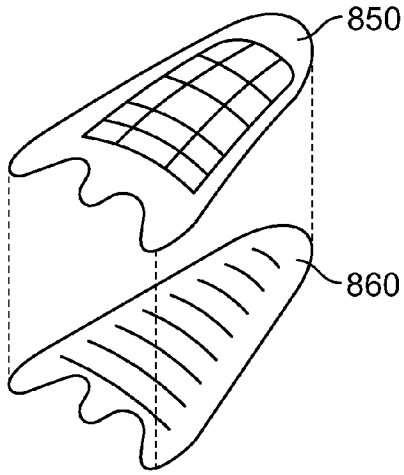

FIGS. 14A and 14B illustrate one embodiment of a device 800, which includes a thin flexible membrane 810 designed to deliver a pulsating wave along its length. A flexible electronic controller 850 drives one or more flexible actuators 860 that are at least partially encapsulated in the thin flexible membrane 810. The flexible membrane may have a curved configuration that defines an internal chamber. Suction can be applied to the internal chamber through various mechanisms, including a deformable suction chamber 820 attached to the membrane 810. Optionally, when the membrane is exposed to air a mild exothermic reaction occurs to further stimulate blood flow.

In one embodiment of the device, the device could create a sweeping wave motion. The speed and amplitude of the wave is variable, selectable and adjustable in real time. The wave motion can also be used to deliver therapeutic substances directly to the genital region. The substances can be stored in the polymeric adhesive region or immediately behind the adhesive region. The mechanical displacement algorithm or, alternately, an algorithm focused on delivery, could be used to meter out drug at the desired rate. Thin-film actuators include shape memory polymers and metals, ferroelectric thin films, polymer thin films, piezoelectric films, polymer/metal composites, and combinations thereof. Light or electromagnetic radiation can be used to power the actuators.

In certain embodiments of the invention, wave motion can be achieved by sequentially charging regions of the thin-film actuator. As each region is energized, that region undergoes a conformational change that causes a local displacement of the structure. Various temporo-spatial patterns can be created to stimulate a stroking motion. Alternatively, some regions may be made to vibrate all other regions provide a simulated stroking motion. The thin-film may be electrically activatable polymer, a piezoelectric material, shape memory polymer, a shape memory metal, or composite material containing one or more of the following materials: metals, polymers, particles, strips, charge elements, water, salt, bases, acids, etc.

Figure 15A:
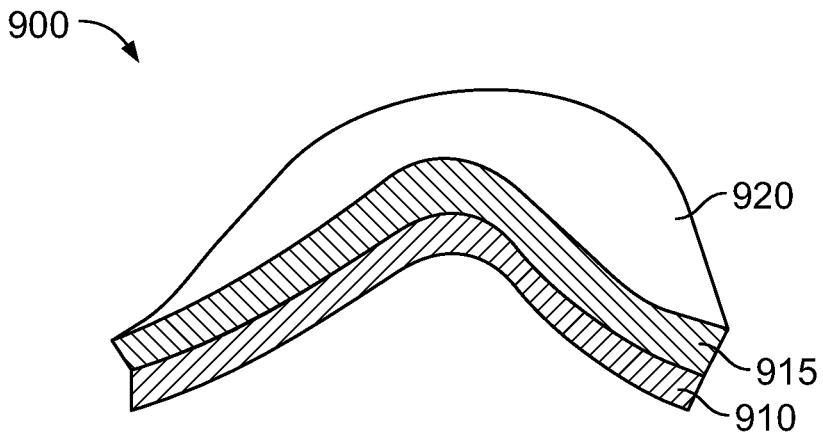
FIGS. 15A and 15B illustrate views of a device according to another embodiment of the invention.
Figure 15B:
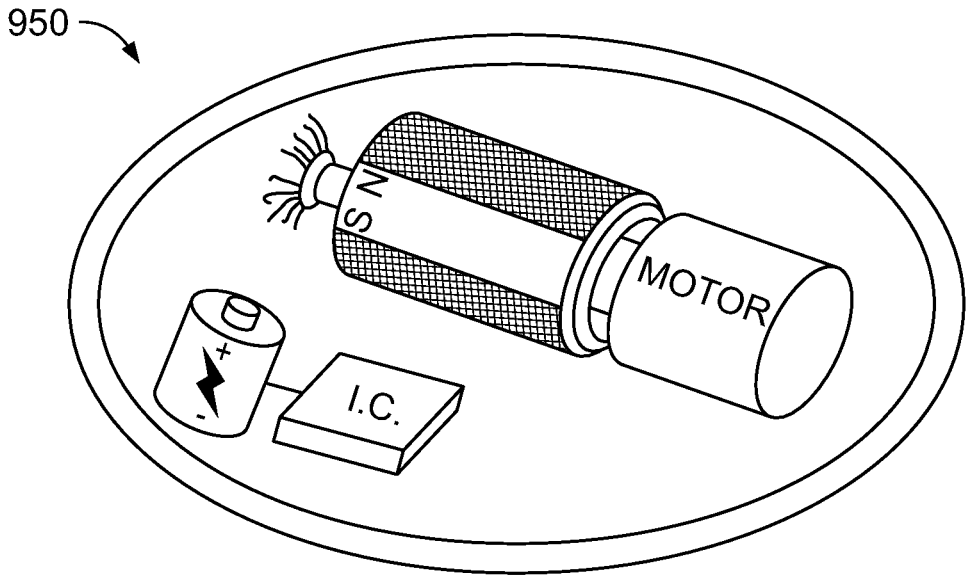

FIGS. 15A and 15B illustrate an embodiment including a magnetically coupled thin-film actuator 900 and controller 950. The thin-film actuator 900 is applied to the clitoral hood and the controller 950 is placed into the vaginal vault. The controller 950 delivers a variable wave electromagnetic energy to the thin-film actuator 900, causing the actuator to vibrate. If the electromagnetic energy is provided by a rotating magnet, the magnet may be eccentric in weight. Such eccentricity allows for local vibration or may also be weighted such that only the thin-film actuator is vibrated. The thin-film may be disposable and comprised of other magnetically adherable material. The controller may be on-board the device or maybe remote. The density of the magnetic element allows for variable focus of actuation along the surface. There may be an adhesive layer 910, such as a mildly adhesive polymer layer, to adhere to tissue. The vibration is caused by electromagnetic activation of magnetic layer 915, which resides between adhesive layer 910 and surface layer 920. The controller includes a rotary magnet, a motor, circuitry, and the power source such as a battery. The controller may be encapsulated for safety, reliability, and comfort.

In another embodiment, a controller may be placed in an interior space of the vagina and physically tethered to a device placed about the clitoris. The controller and the device may be connected using a malleable connector to allow comfortable or tolerable positioning of the device. Advantageously, by moving the relatively heavier control and power components from the clitoral device to the vaginal device, the clitoral device may be more comfortable and wearable. The vaginal device may also include stimulating features such as vibrational motors.

Figure 16:
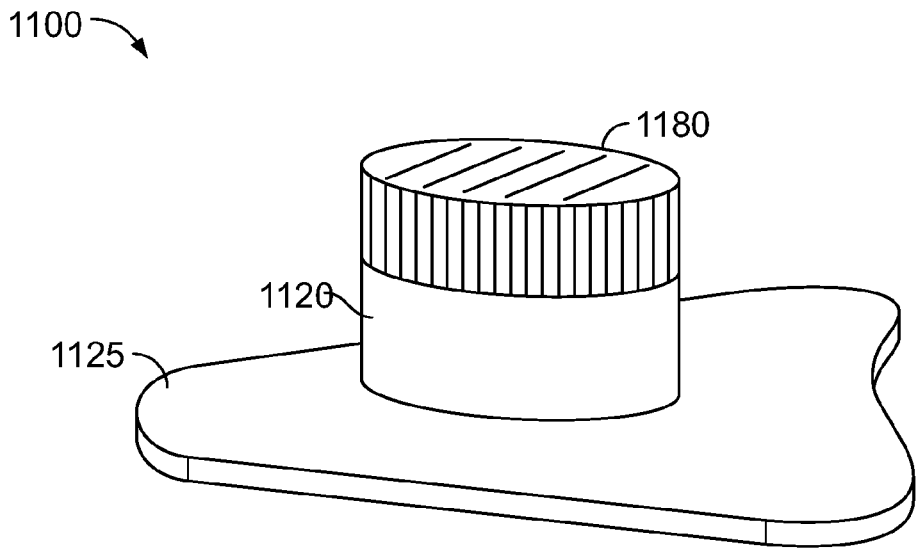
FIG. 16 illustrates a view of a device according to another embodiment of the invention.

FIG. 16 illustrates an embodiment of device 1100 in which a stimulator 1180 is in contact with the top or anterior surface of a suction chamber 1120. Device 1100 includes flange 1125, which provides a substantially airtight seal with tissue while being reasonably comfortable and wearable. Suction chamber 1120 draws tissue into its interior using a separate suction device or by deformation of the suction chamber prior to the device 110 being placed in contact with tissue. When tissue is drawn within suction chamber 1120, stimulator 1180 (or more than one stimulator) may be used to stimulate clitoral tissue. Stimulator 1180 (or motors) may be controlled via a user control area on device 1100 or remotely.

Figure 17:
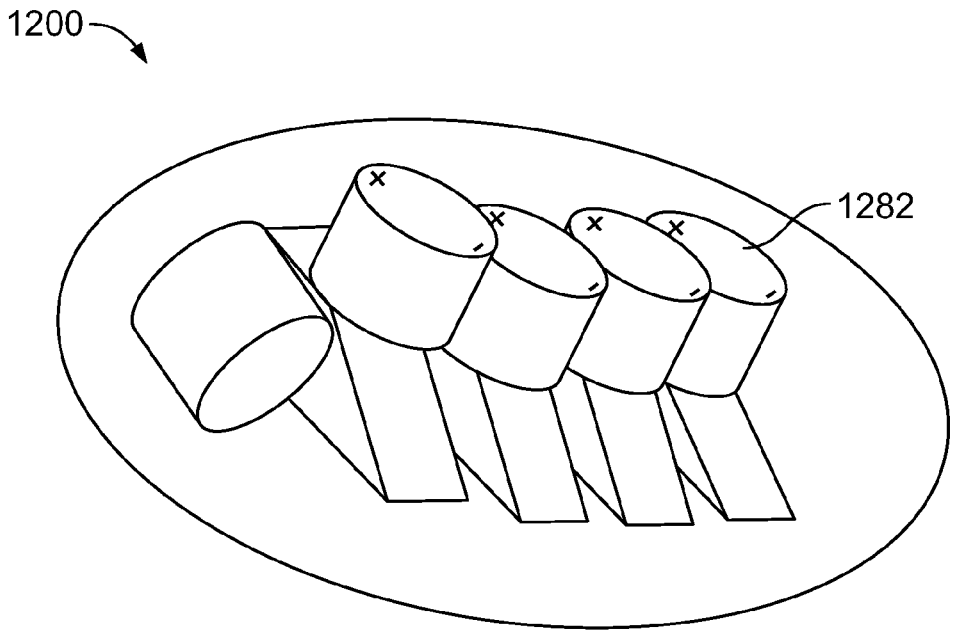
FIG. 17 illustrates a view of a device according to another embodiment of the invention.

Certain embodiments of the invention take advantage of a wide spectrum of input, wider than the input available from certain prior art devices. For example, input may include complex waveforms such as literal music, or superimposed waveforms that make up a type of "song." The multiple oscillations of a "song" can produce a desired mechanical effect on the actuators in contact with tissue. The location or spatial placement of these "songs" could be distributed differentially across the target tissue surfaces to produce enhanced effects. For example, some regions may be more optimally stimulated through low-frequency patterns in other areas through higher frequency patterns. High amplitude patterns in combination with variable mid to high vibrations are also possible. By adjusting these effects spatially, the simulation of manual stimulation, lingual stimulation, or intercourse may be achieved. Multiple stimulation signatures are available to the user to produce different effects. Nominally, some tissue may respond more to a simulated "rubbing" effect and others to a more cyclic "depression" or thumping effect. The "songs" may be downloadable to a remote player or to the device itself through web-based media marketplaces, such as iTunes. FIG. 17 illustrates a device 1200 that includes an array of acousto-mechanical drivers 1282, or voice coils (e.g., "speakers") to create a variable assortment of stimuli across the surface. Each driver 1282 is individually addressable by a controller to generate the complex waveforms and patterns of stimuli described herein.

Figure 18A:
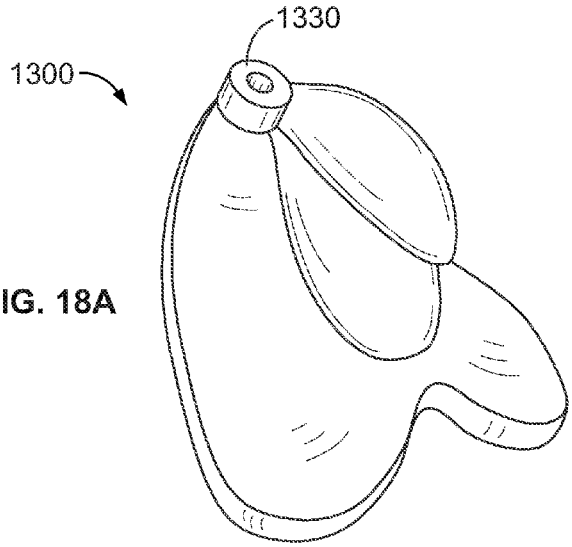
FIGS. 18A and 18B illustrate perspective views of a device and a detachable suction element according to another embodiment of the invention.
Figure 18B:
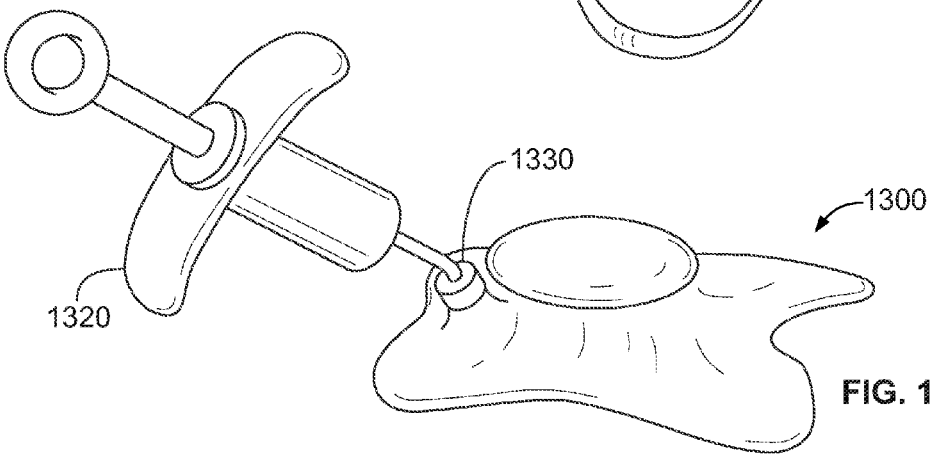

FIGS. 18A and 18B illustrate the interaction of a device 1300 and a separate suction device 1320. The combination of device 1300 and suction device 1320 provide a kit for use according to embodiments described herein. Device 1300 includes a suction port 1330 that is in fluid communication with the interior of a suction chamber (not labeled) on device 1300. Suction device 1320 is depicted as a syringe-type suction device but other suction devices are within the scope of this disclosure. A separate suction device allows for the precise, repeatable, and reliable application of suction and as well as discreet and comfortable wearing of device 1300.

Figure 19:
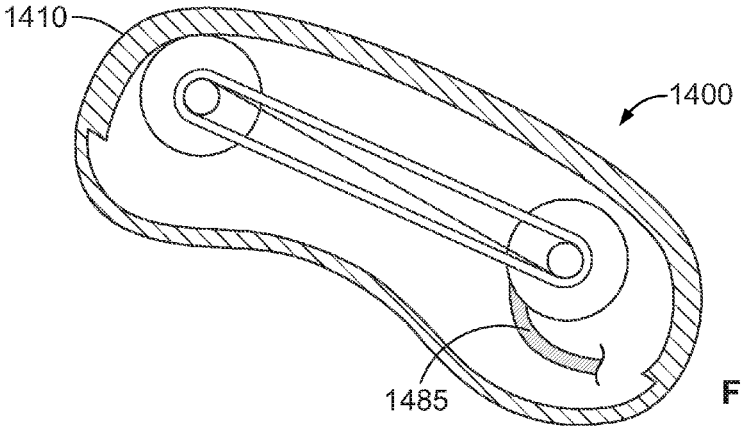
FIG. 19 illustrates a cross-sectional view of a device according to another embodiment of the invention.

FIG. 19 illustrates an embodiment of device 1400 in which a stimulating feature 1485 is driven by a motor housed within a device body 1410. Device 1400 is placed in contact with clitoral tissue by suction means described herein or by placing the device in close contact with tissue via a garment or garment-like apparatus. Stimulating feature 1485 provides macroscopic motion to stimulate engorgement of the clitoris by providing a more natural stroking and/or lingual motion as compared to a vibratory motion. Device 1400 may include one or more stimulating features.

In certain embodiments, the controller is designed to map the user's motions on a control surface to the tissue-contacting surface of the stimulating part of the device. By pressing their fingers on the control surface, the user can create various levels of pressure a vibration in the corresponding location on the tissue-contacting surface. As the user moves their fingers across the control surface and optimally desired way, a sequence of motions, pressures, vibrations, and/or stimuli that mimic these actions are created on the tissue-contacting surface. These movements and inputs can be stored either locally on the device or a controller level and played back when desired to create desired effect without requiring the user to repeat their input pattern.

Figure 20:
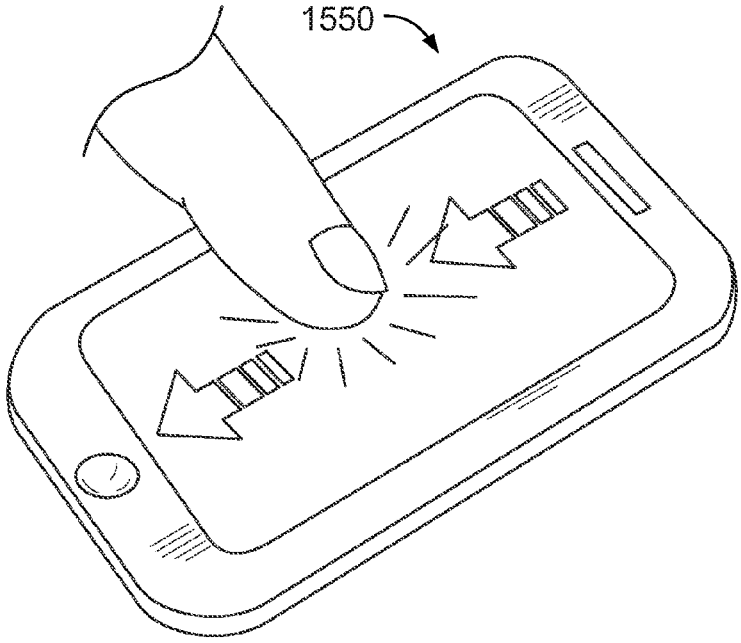
FIG. 20 illustrates a cross-sectional view of a device and a perspective view of a controller according to another embodiment of the invention.
Figure 20:
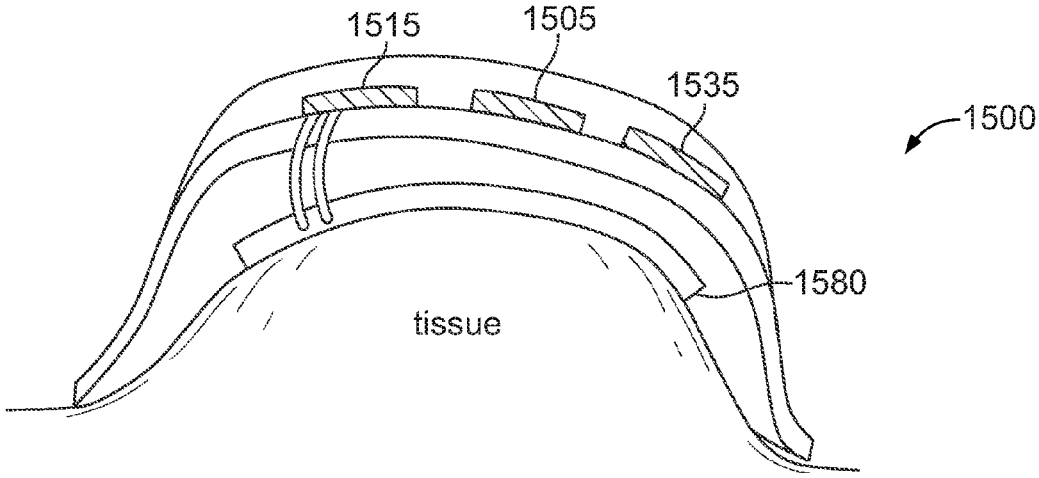

FIG. 20 illustrates an embodiment of a device 1500, which can be remotely controlled by a touchpad device 1550 to provide precise and customizable stimulation. Touchpad device 1550 may be a smartphone or other equivalent device. Device 1500 includes electro-active layer 1580, which directly contacts tissue or contacts tissue through a thin membrane. Tissue is drawn into contact with electro-active layer 1580 through methods described herein. Device 1500 includes a power source 1515, a local controller 1505, and an antenna 1535. Electro-active layer 1580 is configured to mimic the motion and pressure applied by the user's finger on the touchpad device 1550 to the clitoral tissue within device 1500.

Figure 26A:
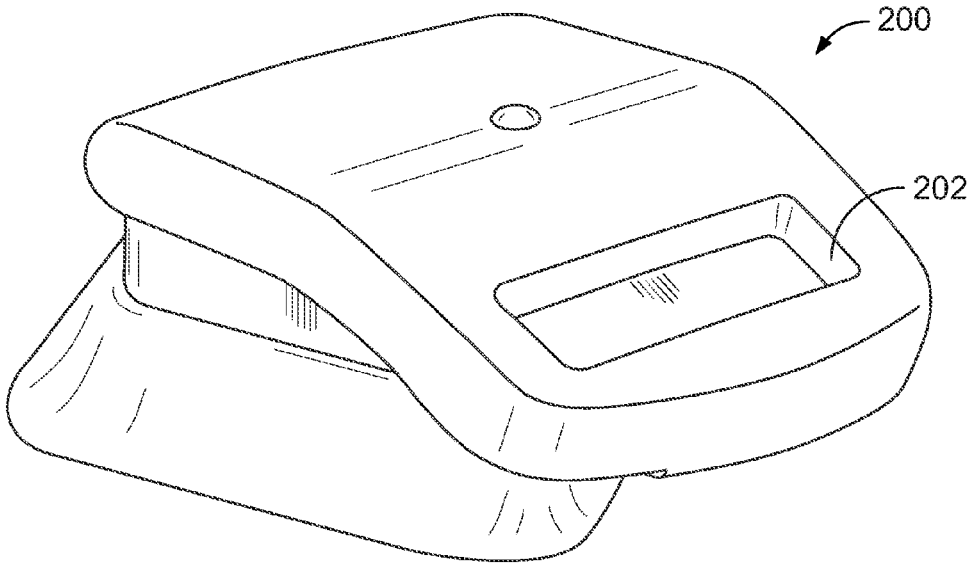
FIGS. 26A and 26B illustrate views of a device and a controller according to an embodiment of the invention.
Figure 26B:
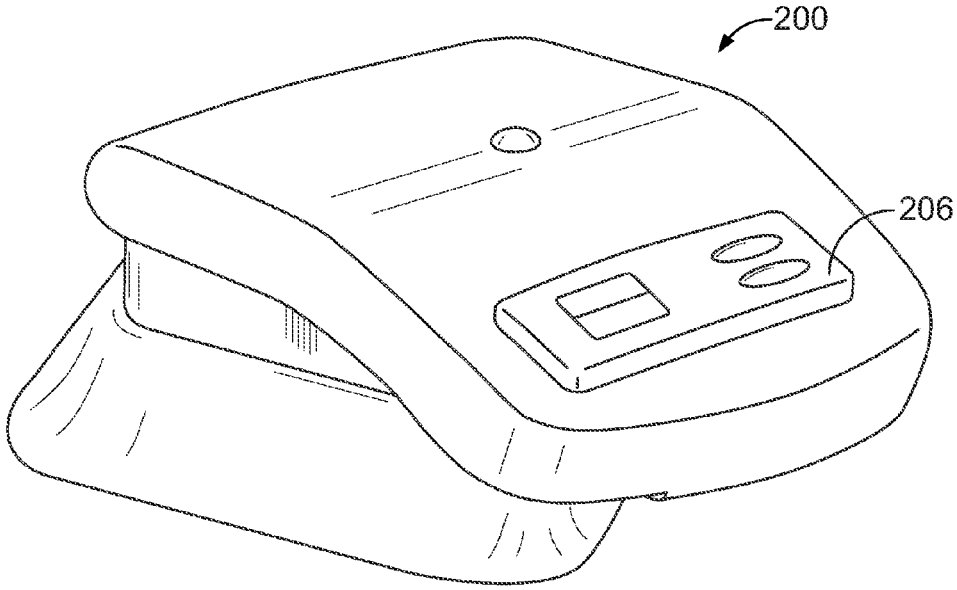

In certain embodiments, a remote controller is a controller configured to send radio-frequency signals to the device worn by the user. The controller may be sized similar to a key fob remote control commonly associated with automobiles. A key fob styled remote can include several buttons capable of controlling the full range of functions of the device discussed herein. FIGS. 26A and 26B illustrate a key fob styled remote controller 206 and device 200, which includes a complementary housing space 202 such that the remote 206 can be docked with the device and housed there when not in use or even when in use. In general, the controller circuitry can include a circuit board, amplifiers, radio antennae (including Bluetooth antennae).

In certain embodiments, the controller is physically tethered to the device worn by the user. The tether can include electrical connection as well as a fluid connection to provide suction to the suction chamber on the device.

In certain embodiments, the stiffness of parts of the device, such as the suction chamber, an arm suspending a vibratory motor, or stimulating feature, can be controlled by moved a stiffening member, such as a stylet, in or out of a receiving lumen in the part whose stiffness is being controlled.

Figure 21:
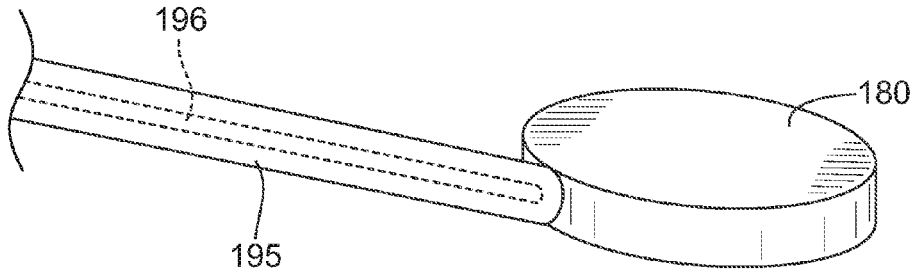
FIGS. 21 and 22 illustrate stimulator and lever arrangements according to embodiments of the invention.
Figure 22:
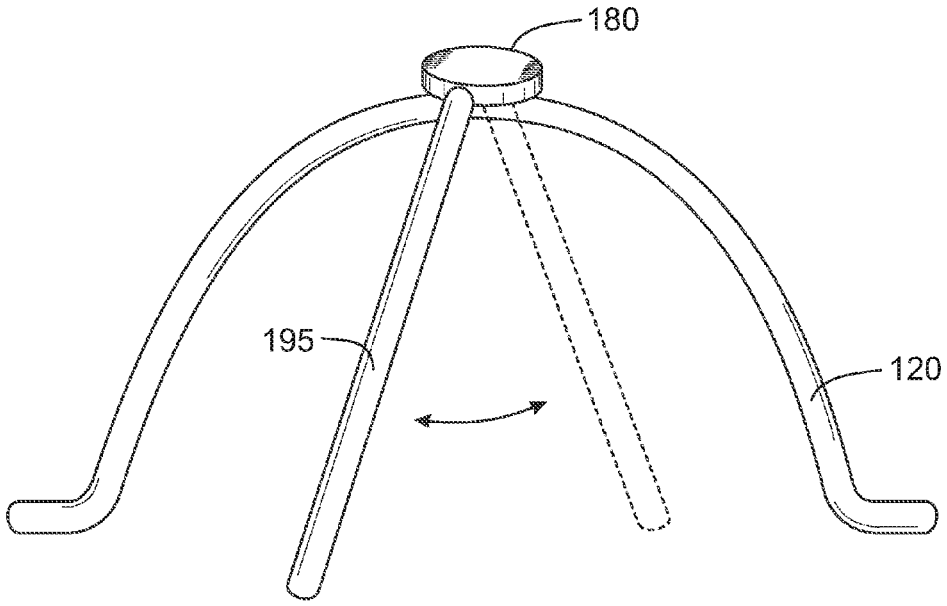

FIG. 21 illustrates an embodiment of a device in which stimulator 180 is coupled to the end of lever 195. Lever 195 has an interior receiving lumen for receiving a stiffening stylet. By stiffening lever 195, which may be attached to a device body, or to a suction chamber such as the chamber pictured in FIG. 13, the stimulator 180 may be made to more firmly engage tissue. FIG. 22 depicts an embodiment in which lever 195 is coupled to oscillating motor 180, which is attached to suction chamber 120. Lever 195 is driven to have a larger motion at its far end relative to the smaller motion of oscillating motor 180. In such an embodiment, lever 195 provides the sensation of macroscopic motion using the relatively small motions of the couple motor.

Figure 23A:
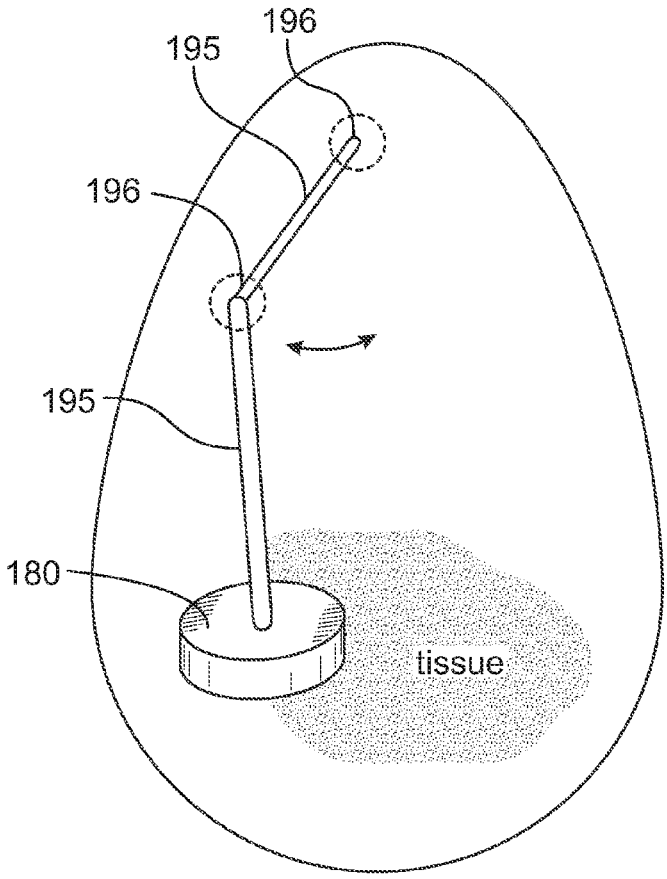
FIGS. 23A and 23B illustrate a device providing macroscopic motion according to an embodiment of the invention.
Figure 23B:
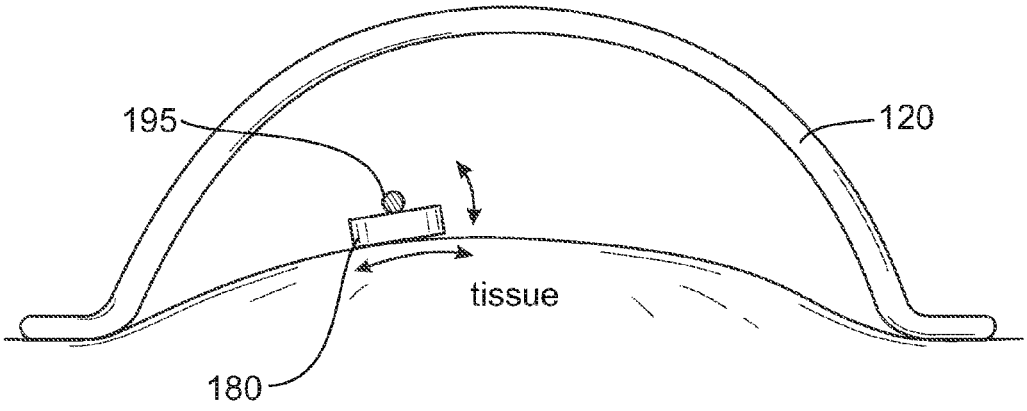
Figure 24A:
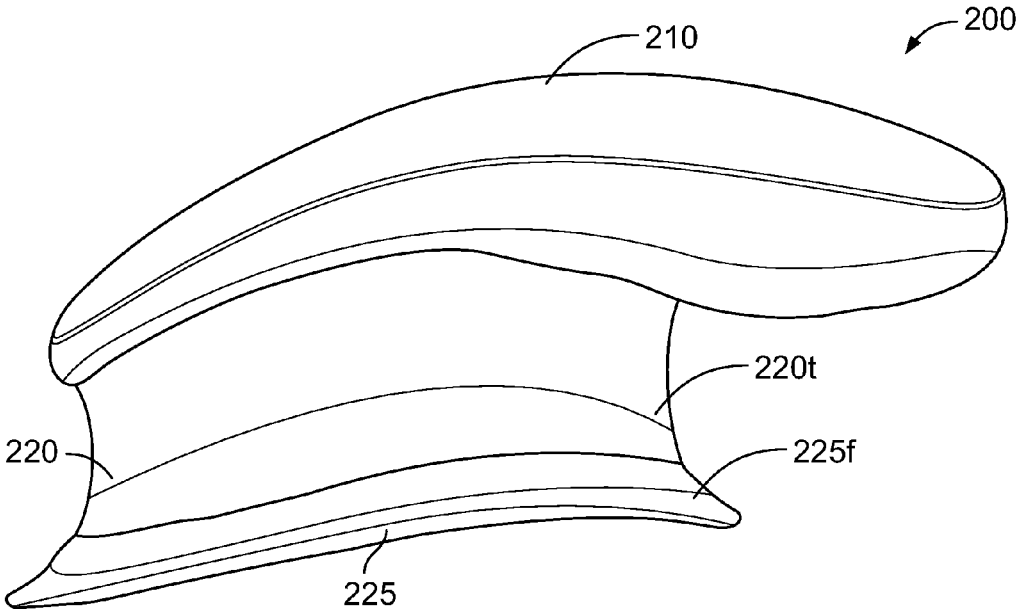
FIGS. 24A through 24D illustrate various views of a device according to an embodiment of the invention.
Figure 24B:
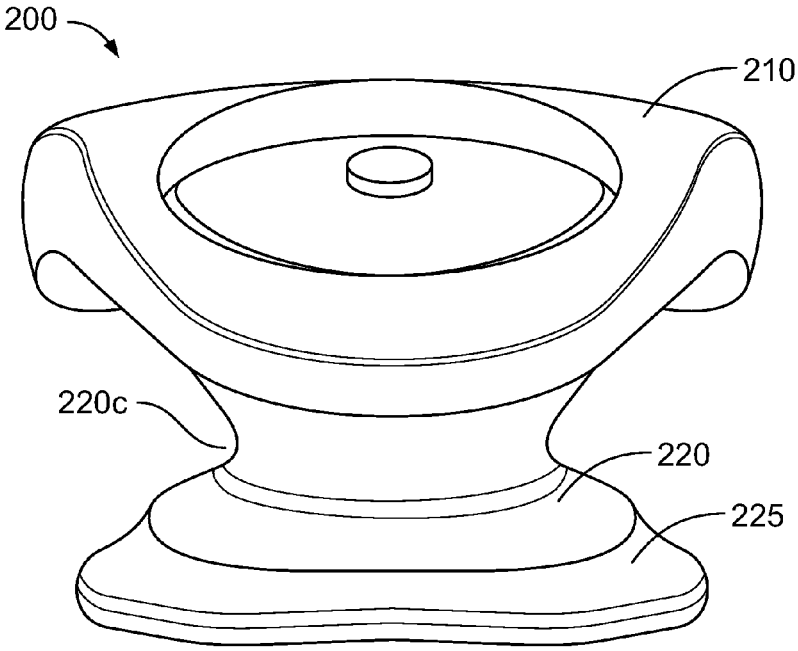
Figure 24C:
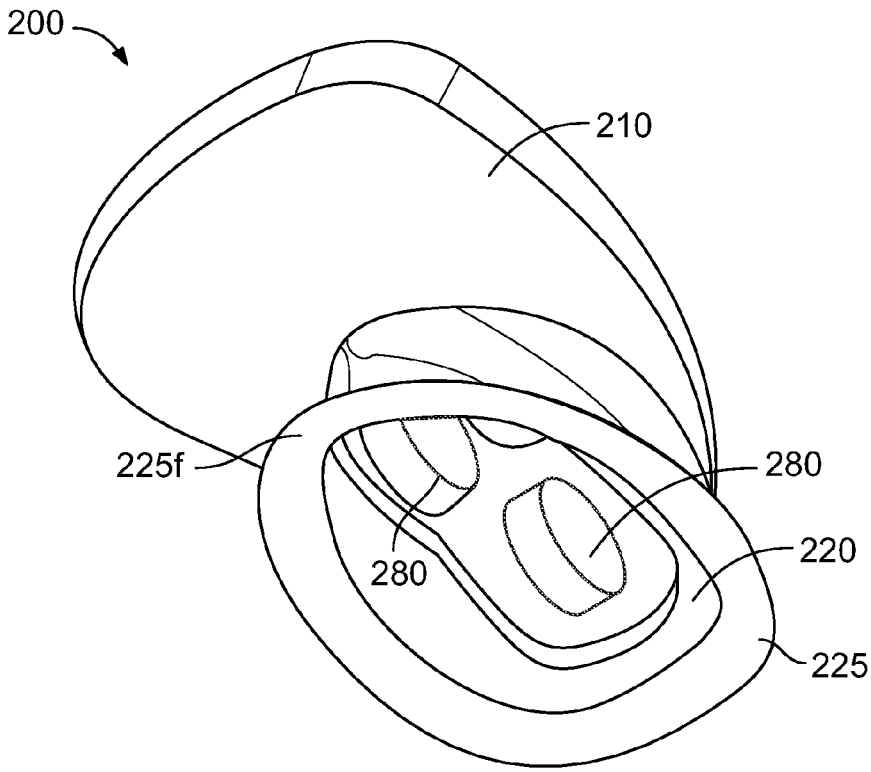
Figure 24D:
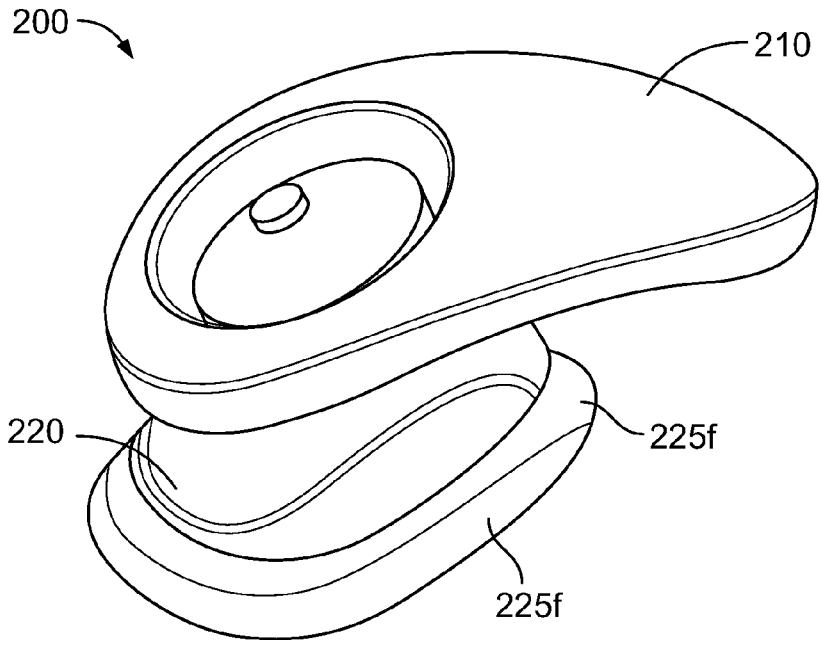

FIGS. 23A and 23B depict an embodiment in which a stimulator 180 is mounted within suction chamber 120. FIG. 23A depicts a sectional plan view and illustrates a mechanism including two levers 195 and two pivot points 196. The pivot points and levers cooperate to sweep stimulator 180 across the target tissue. While the mechanism is depicted with two lever and two pivot points, other combinations of mechanical elements are possible provided that they generate a controllable sweeping or stroking motion across the target tissue. FIG. 23B depicts a sectional end view, which illustrates stimulator 180 as both sweeping across tissue and pivoting about the longitudinal axis of lever 195. In certain embodiments, the pivoting motion is passive and conforms to the shape of the tissue to maintain substantial contact between stimulator 180 and target tissue. In other embodiments, the pivoting motion is actively controlled and can be used to deliver more stimulating force to target tissue. For example, as described herein, miniature coin style motors with an eccentric mass deliver more force when placed edge-on to tissue. By actively pivoting the motors, differential force effects can be achieved. Pivot point 196 may also be passive or active in the sense that they may be motors capable of driving the sweeping motion or they may be comparatively simple joint that allow the motor to be swept across tissue by a driving force at one of the points or within the case of the device.

Some of the embodiments of the device deliver suction to engorge and stiffen the tissues and vibration to provide stimulation to the region. In other embodiments, the device delivers suction to engorge and stiffen the tissues and electrical or neural stimulation provides stimulation to the region. In other embodiments, warming or cooling is applied instead of vibration or electrical or neural stimulation or in combination with those stimulation types. The stimulation source preferably is in intimate contact with the tissue to optimize energy transfer.

The mounting of the vibration sources may also allow for isolation so that there is spatial differentiation between sources and minimal diffusion of vibratory energy to adjacent structures in the device or tissue. Mounting stimulators on a flexible membrane which travels with the tissue as it becomes engorged with suction may accomplish these goals. However, the membrane should have a direct path between the suction source and tissue—if there is no path the amount of suction delivered will be significantly lower. Placing holes or slits in the membrane may allow for sufficient vacuum and energy transfer. However, holes or slits are placed in the membrane may allow fluid from the tissues to travel through the membrane into the interior vibration source region of the device.

Figure 27A:
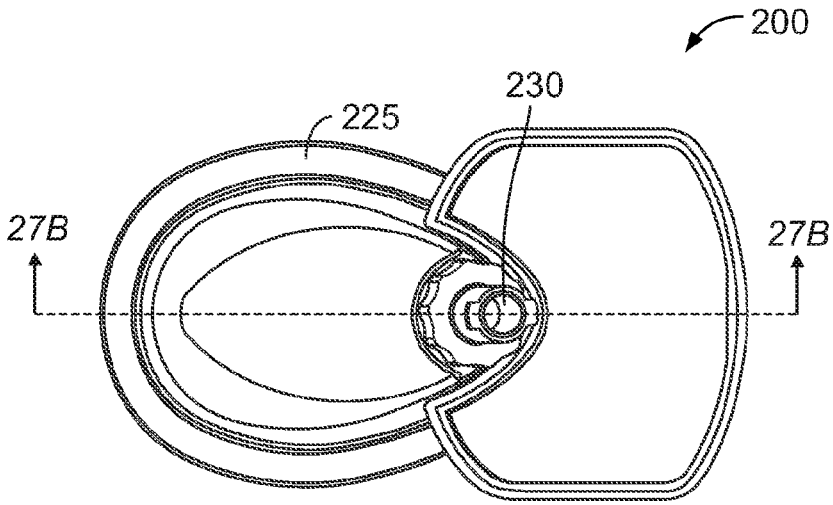
FIGS. 27A and 27B illustrate views of a device according to an embodiment of the invention.
Figure 27B:
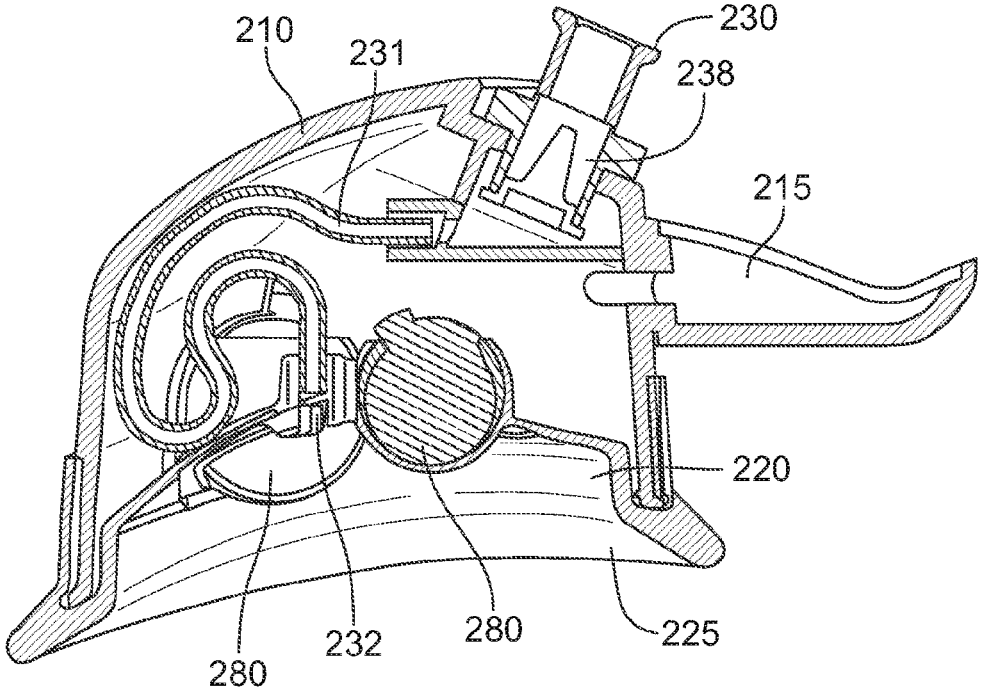

FIGS. 27A and 27B illustrate a plan view and a cross-sectional view of a device according to certain embodiments. Device 200 includes device body 210 and suction chamber 220. Suction chamber 220 includes sealing edge 225, which is adapted to provide a substantially airtight seal against tissue. Suction port 230 provides fluid communication between the interior of suction port 220 and a suction device (not pictured) that can be detachable or remain attached. Device body 210 includes a user control area 215. It is understood that the user control area may contain multiple control inputs. Further, the device 200 may be controlled remotely. Multiple vibratory motors 280 are coupled to the inner walls of suction chamber 220. Suction inlet 232 includes duck bill valve 238 (or a check valve or other one-way valve) connecting suction port 232 to the interior of suction chamber 220. Device body 210 includes a firm but flexible shell, which houses electronics and couples the electronics to suction chamber 220. Device body 210 may further include a charging port to recharge the power source included in controller block 215. Activation buttons present in the user control area may be recessed or otherwise made comfortable, safe, and reliable. Sealing edge 225 may include soft, flexible, compliant material, and may optionally be mildly adhesive to tissue or may be adapted to contain an adhesive material. Device body 210 is configured such that the posterior, or underside, of device body 210 is in a different plane than sealing edge 225. This configuration allows device body 210 to ride over the pubic bone of the user and to optionally attach to a garment while sealing edge 225 is in contact with tissue.

FIG. 27B depicts suction tube 231 connecting suction inlet 232 with suction port 230. The suction tube material is chosen to be resistant to adhesion by biological material. The path of the suction tube through the device housing can be configured to account for pressure drops and to avoid areas where fluid may pool. The suction tube provides an additional barrier between fluid and the electromechanical and electrical components within the interior housing of the device body.

In embodiments including a suction tube, there is a pressure differential between the chamber above and below the membrane. When suction is applied, the area above the membrane is at higher pressure than the area below the membrane which can encourage the membrane to move down toward tissue, thereby increasing contact forces between the motors and tissue. This pressure differential mechanism can be actively used to increase energy transmission.

The challenge of cleaning fluid from interior regions of the device is addressed by enabling the flexible portion of the suction cup to be removed from the housing so it can be cleaned by the user. Alternately, as depicted in FIGS. 27A and 27B, a tube could be connected between the suction luer and a single hole in the membrane. The interior of this hole may have features (e.g., protrusions, a permeable shield, and the like) to prevent the tissue from clogging the hole when vacuum is applied. In this case, fluid would not be able to enter the interior surfaces of the device and would be contained to the tissue interface and the suction tube channel. These regions could be rinsed by the user without disassembly.

Figure 33:
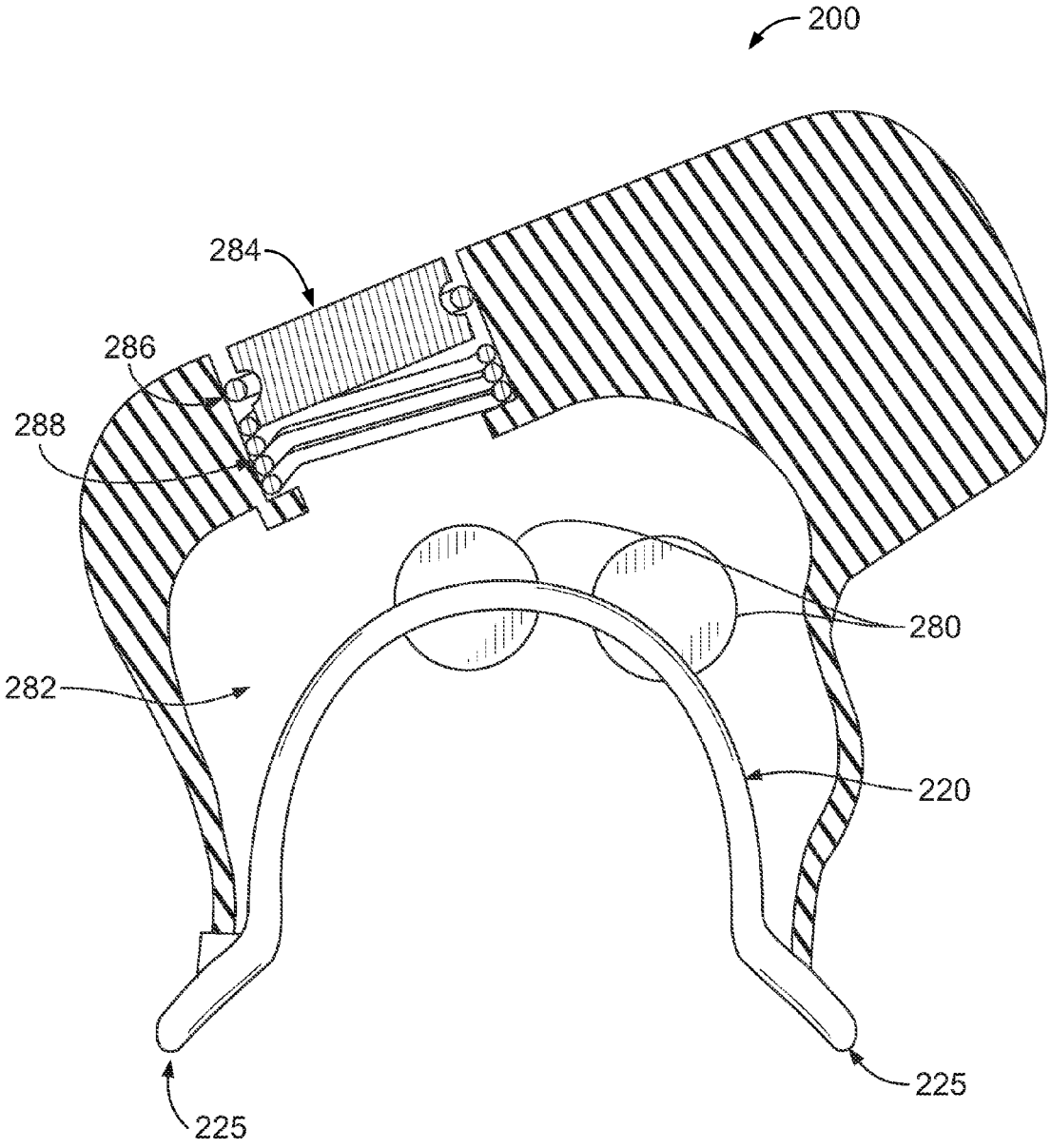
FIG. 33 is a partial cross-sectional view of another embodiment of the invention.

To address the challenge of cleaning, in another embodiment as shown in FIG. 33, no fluid is allowed to enter the interior 282 of the device 200 such that the surface under suction chamber 220 and all of the external surfaces of device 200 can be easily cleaned with soap and water. Interior 282 can be vacuum sealed or contain a gel or fluid. The embodiment of device 200 in FIG. 33 has a non-deformable button 284. Button 284 has an O-ring 286 to form a seal around the button. Button 284 is mounted on a spring 288 such that when button 284 is depressed and released it is biased toward its starting position. Sealing edge 225 creates a seal with the woman's tissue. Suction chamber 220 is a resilient membrane dome that is biased to return to its starting position. Displacement of button 284 forces pressure downward on the resilient membrane dome which forces air out from under suction chamber 220. The sealing edge 225 in contact with the tissue acts likes a one-way valve and as the button is released, the resilient membrane tries to return to its starting position thus creating suction under suction chamber 220 to create negative pressure over the clitoris and encourage engorgement. A biasing member can be added to the suction chamber dome to increase the recoil.

Figure 28:
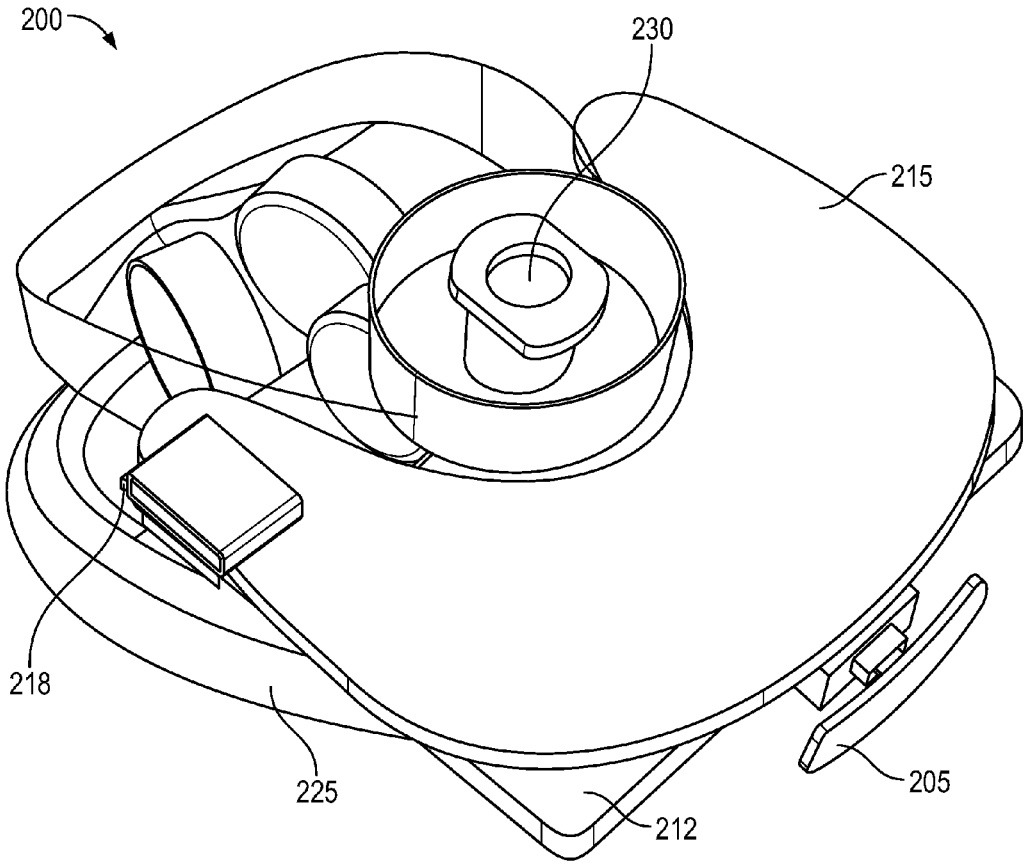
FIG. 28 illustrates a view of a device according to an embodiment of the invention.
Figure 29:
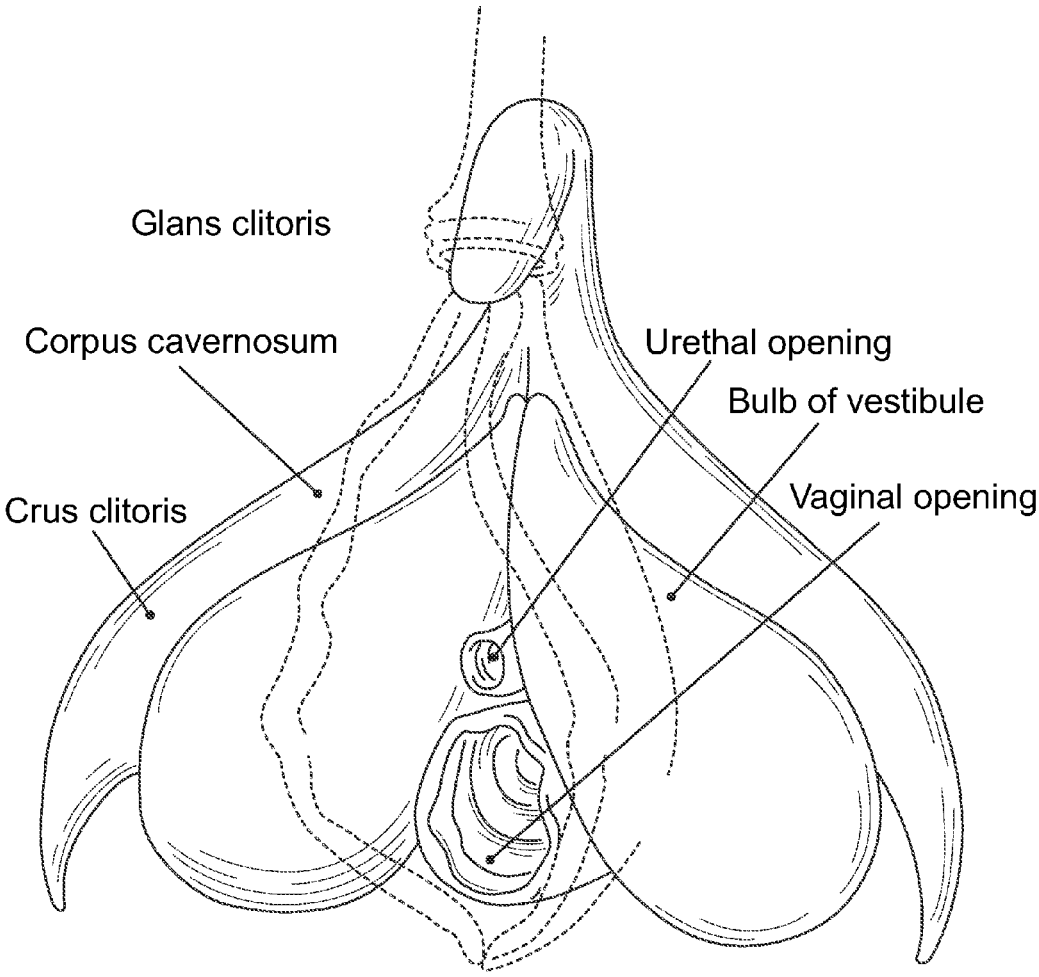
FIG. 29 illustrates a view of certain elements of the human female anatomy relevant to embodiments of the invention.
Figure 30:
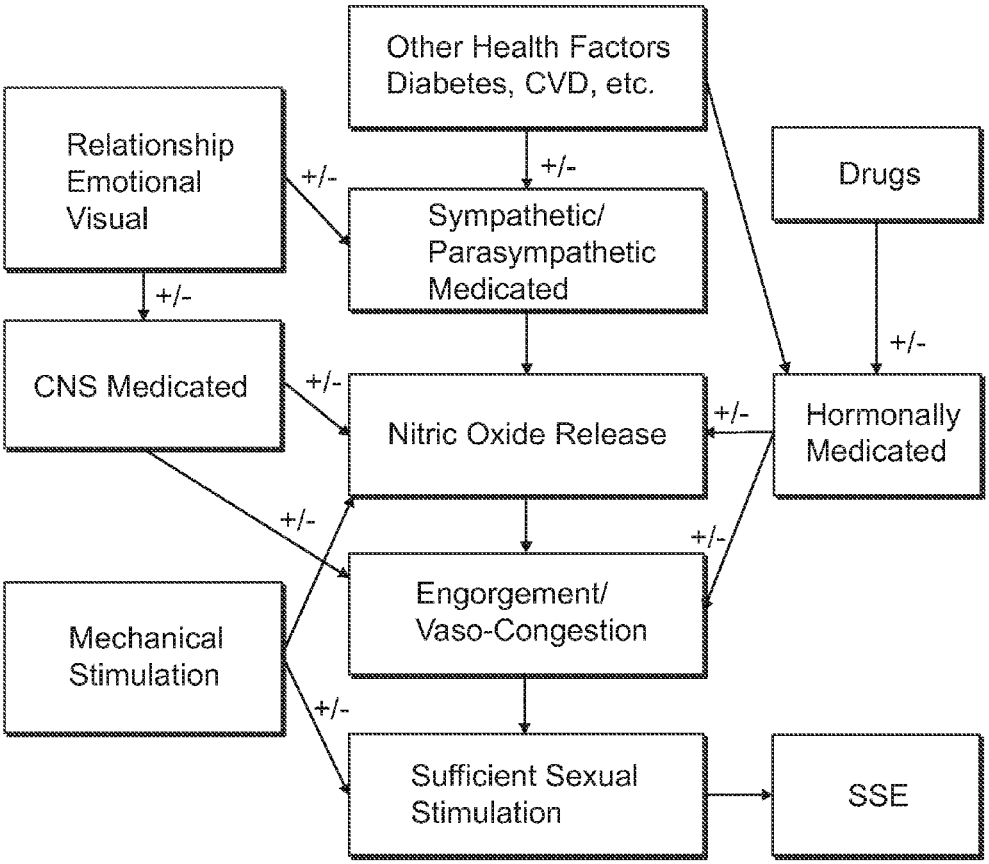
FIG. 30 is a flowchart illustrating multiple inhibitors and promoters of a satisfying sexual experience and their interdependence.

FIG. 28 depicts a view of a device 200 with the outer housing removed. Controller block 215 (or circuit board) is housed underneath the outer housing and between suction port 230 and activation button 205. Activation button 205 is, of course, operably connected to controller block 215 as is I/O port 218. I/O port 218 can plug into an interface cable (or an interface port in a holder) that can be used to program and/or charge the device. Battery 212 is underneath controller block 215.

Certain materials may be preferable for use as actuators in devices disclosed herein. For example, electro-active polymers expand and contract with the application of electrical current and can incorporate taxels (focal points) to increase resolution. Electro-active polymers can be packed in dense arrays, are highly customizable, and show good frequency range. Some designs are extremely low profile. Piezoelectric materials are another example. Piezoelectric crystals generate stepping function movement that can be used for rotary or linear motion and/or vibration. Piezoelectric materials can be miniaturized and incorporated into electronics and show good frequency range. Another example is voice coils in which linear motion is caused by generation of electrical field around a magnet. Voice coils can achieve high amplitude with low voltage and are smaller size than miniature coin cell motors.

Voice coils can also allow more control flexibility than rotary motors—the frequency and amplitude can be decoupled from each other. Voice coils also allow for greater isolation of vibrational energy because only the moving element vibrates and the housing is essentially stationary. This can allow for greater spatial differentiation.

Certain actuator materials may be used to form an actuator array that provides high spatial resolution for vibrations. For example, an array that provides for 14 vibratory sources could improve the sensation of motion delivered to the user and provide for significant customization modes. In this example, each vibration node is 4 mm in diameter, significantly smaller than the 8 to 15 mm diameter coin cell motors. A vibration node of 4 to 6 mm in diameter would be desirable for this application to achieve the intended resolution.

Certain embodiments are capable of approximating kinesthetic forces (or macroscopic motions such as palpation or rubbing) using an array of vibrational motors. Devices disclosed herein are capable of achieving (or at least simulating) kinesthetic (or macroscopic) sensations using actuators that typically produce only tactile sensations. Devices capable of producing a convincing, organic-feeling palpation sensation rely on the coordination of: (i) motor spacing in the array (preferably, motors are spaced at about 1-4 mm); (ii) breadth of field of each motor; (iii) traversal rate for a pattern played on the motors; and (iv) overlap.

According to certain embodiments, devices fabricated as described herein are able to tune strength, traversal rate, and overlap, to the fixed physical parameters like the motor spacing, skin contact, etc. Various algorithms allow independent control of motor strength, traversal rate, and overlap. In a device fabricated according to embodiments disclosed herein, an algorithm was implemented in a low-cost embedded microcontroller. Three input parameters were varied, by radio control using Bluetooth Low Energy components communicating from an iOS device (iPod of iPhone 5 generation) to an embedded microcontroller (Texas Instruments CC2540), to ultimately set those algorithm input parameters. The algorithm output controlled pulse width modulated drives for all 3 to 5 motors simultaneously. The algorithm also allowed for unique patterns such that the user could specify order of traversal through the motor array. Different profiles, e.g. square, sine, ramp, were used to turn on the different motors at different rates as the pattern progressed through the motor array.

For motors with a non-linear response curve, feed-forward techniques (or feed-back if sensors are incorporated in the device) can compensate for such a response curve. Thus, motors turn on when commanded as opposed to with a lag, so that the coordination discussed above can be achieved. In some embodiments, an accelerometer may compensate for effects of gravity.

Miniature coin-style vibratory motors having an eccentric mass are used in certain embodiments. Generally speaking, coin-style motors require larger masses and higher power in order to increase the stimulating force delivered to tissue. Thus, the stimulating force in eccentric motors is a function of mass, and more power is required to drive that mass. In certain embodiments described herein, despite the relatively high mass and relatively high power of the motors the devices can provide spatially-differentiated vibration via the isolation structures and methods described herein. Even when the motors are positioned relatively close together to provide a close fit to the clitoris, embodiments described herein can provide substantial vibrational isolation and provide the user with a spatially-differentiated stimulation experience.

In certain embodiments, modified voice coils are used as the stimulators. As described above, voice coils can achieve high amplitude with low voltage and are smaller size than miniature coin style motors. Voice coils can be modified to include a mass attached to the membrane driven by the electromagnetic field. Advantageously, such mass-bearing voice coils retain the desirable properties of voices coils, including rapid response time, high acceleration, high precision force control, and relatively low power consumption.

Embodiments of the device may have variable suction controlled by the user or another remote controller. A user may remotely select a pressure and the device will change to that pressure within seconds. The device may include an onboard pump that maintains suction and/or goes up/down from that initial established suction. Certain diaphragm pumps may be used as onboard pumps. Further, the motor driving the diaphragm pump may be used to produce vibratory motion. In certain embodiments, the onboard pump can be a modified voice coil designed to mimic the action of a diaphragm pump. The onboard pump can alternately be made with using a voice coil actuator that moves a membrane in a sealed and valved chamber.

In embodiments using an onboard pump or in embodiments using a remote pump, the suction may be programmed to complement the vibratory motion of the motors or the macroscopic motion of stimulators in the device. The algorithms described herein to drive vibration are adapted to vacuum pump system to provide fast response times and physically differentiable levels of suction to the clitoris. Further, certain embodiments use simultaneous or sequential suction waveforms or algorithms and vibration waveforms or algorithms to amplify the effect of the device.

In certain embodiments, it is desirable to release suction during use. For example, the edge of the suction cup could be pulled back, squeezed, or manipulated to create a leak path. Further, a valve in line with the suction tube that can be manually manipulated by the user to release suction. In embodiments using an on-board suction pump, the pump can be configured to include a constant leak path that the pump overcomes—therefore, if the pump stops the device will automatically release. Still further, the device can be configured with a button that the user presses which opens a valve in the pump to release suction. Still further, the valve needed for the suction pump could be normally open. When power is supplied, the valve closes, completing the seal. However, if power goes out, the valve will open and the device will release automatically.

Certain embodiments of the present invention are designed and configured to increase blood circulation in vaginal tissue to promote engorgement to the clitoris and external genitalia while simultaneously applying stimulation to the clitoris and/or other vaginal tissue. The clitoris is a sexual organ that is filled with capillaries that supply blood to a high concentration of nerves. Certain embodiments increase blood flow to stimulate the clitoris and enhance a woman's sexual response.

In women presenting symptoms ranging from sexual dissatisfaction to sexual dysfunction, methods and devices of certain embodiments can provide: (i) increased genital sensation; (ii) improved vaginal lubrication; (iii) improved sexual satisfaction; (iv) improved sexual desire; and/or (v) improved orgasm. Certain embodiments of the invention are designed and configured to be used to treat women with diminished (i) arousal, (ii) lubrication, (iii) sexual desire, and/or (iv) ability to achieve orgasm.

Certain embodiments of the invention are designed and configured to be a wearable device designed to increase sexual satisfaction. Certain embodiments of the invention are designed and configured to be used as a "conditioning" product, to prime the user before a sexual event. Certain embodiments can be: used to help a woman prepare her body in advance of a sexual experience, typically with 5-30 minutes of use prior to sex; worn during a sexual experience with a partner, including intercourse; used by a woman alone for recreational purposes to reach orgasm; used as a regime, typically used a few minutes every day, to help facilitate a more intense and pleasurable experience during intercourse with or without a partner; or used over time to help train the body to achieve a better natural sexual response.

Figure 32A:
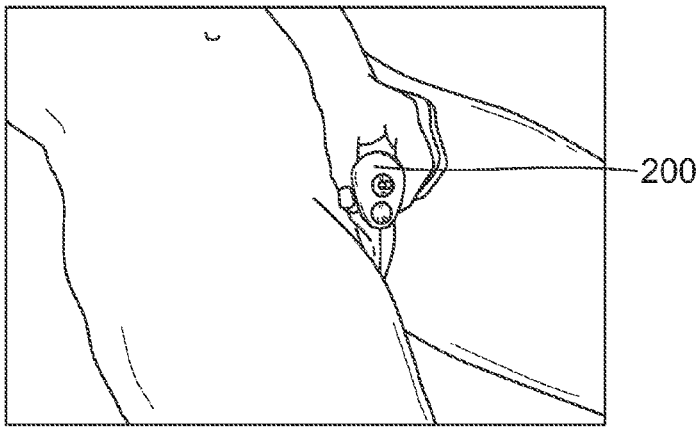
FIGS. 32A through 32E illustrate use of various embodiments of the invention.
Figure 32B:
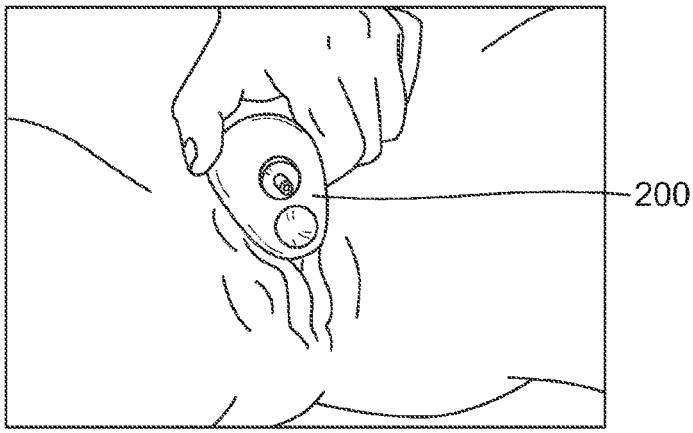
Figure 32C:
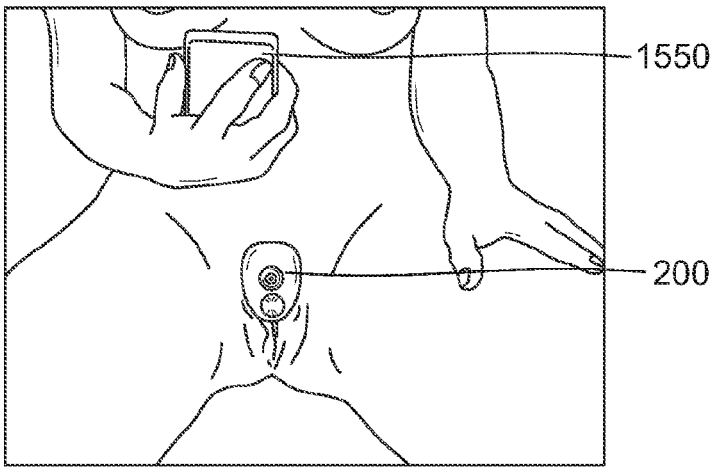
Figure 32D:
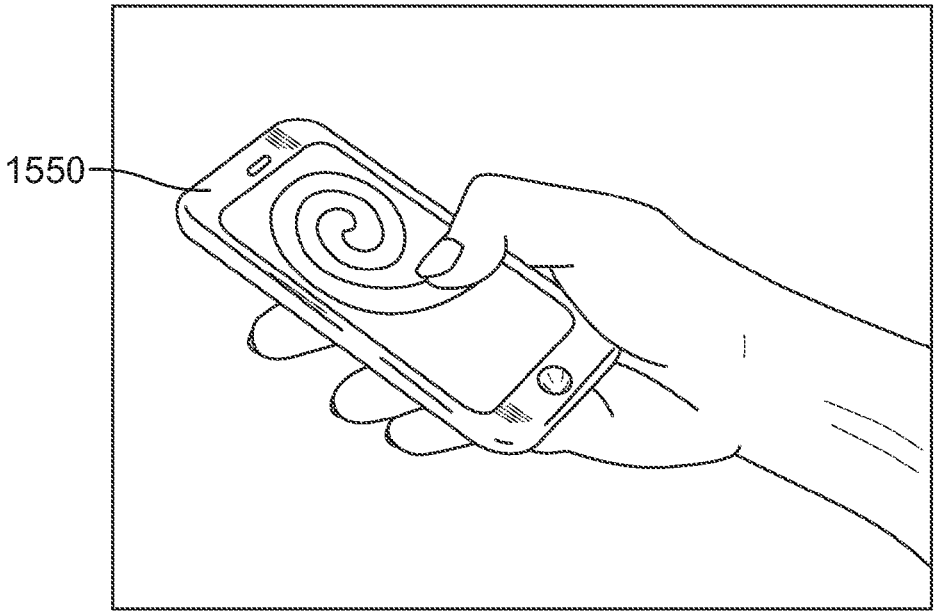
Figure 32E:
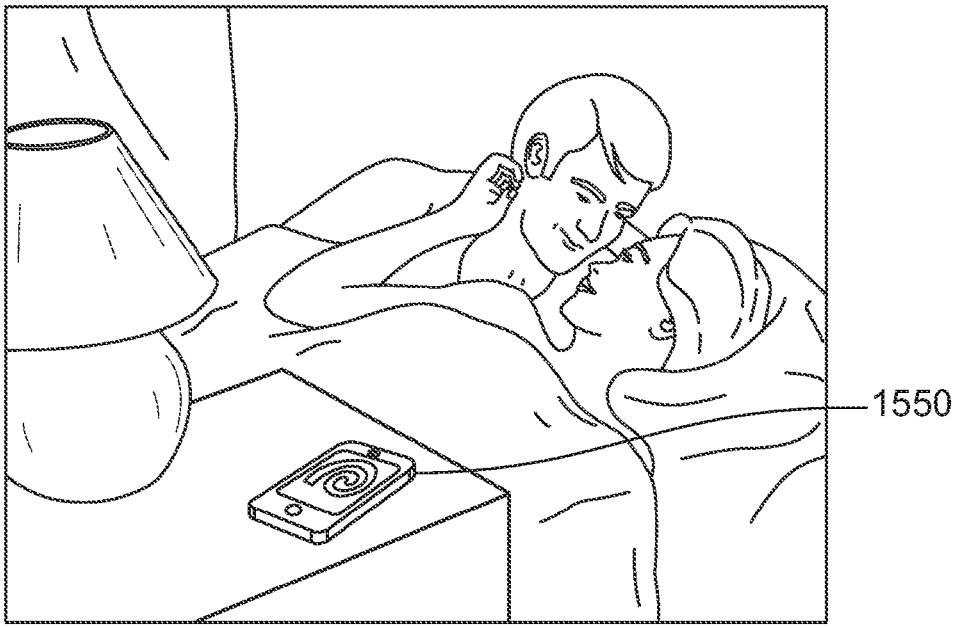

The device 200 is placed over the clitoris (FIGS. 32A-32B) by a woman, her partner or physician. Gentle suction allows the product to stay in place (so it can be completely hands free once placed), although it can be quickly and easily removed as desired. A woman can sit, stand up and walk around while wearing the device 200. As shown in FIG. 32C, a small remote control 1550 or smartphone "app" is used to adjust the device's vibration intensity and unique stroking patterns (such as the counter-clockwise movement pictured in FIGS. 32D-32E). The sequence can be customized in advance and "playlists" can be created. Once in place, the device 200 provides quiet, hands-free sexual stimulation to the clitoral region, working with a woman's body to help improve sexual response. Certain embodiments are small (about 1.5 inches long by about 1 inch wide), quiet, waterproof and discreet. The product is latex-free, hypoallergenic and washable with soap and water. It is quick and easy to place on the body, and can easily be removed. It may be worn under clothing without anyone knowing the user has it on. Since it is a hands-free product, the user can easily move around, stand or walk while wearing the device for a few minutes a day while doing something else to help a woman's body maintain a higher level of sexual responsiveness.

Certain embodiments of the invention include device and methods to enhance female sexual wellness and female sexual pleasure and some methods are for treatment of female sexual dysfunction. Certain embodiments of the invention include device and methods to treat (i) female sexual arousal disorder, (ii) hypoactive sexual desire disorder, and/or (iii) female orgasmic disorder. The methods naturally enhance a woman's own sexual response without undesirable, lasting side-effects. A woman will enjoy sexual intimacy again and feel confident in her body's ability to respond to sexual stimulation.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An apparatus for promoting sexual arousal in a female user, comprising:

a tissue-contacting chamber including a suction chamber; and at least two motor type stimulators that are individually controlled and flexibly suspended at least partially within the suction chamber.

2. The apparatus of claim 1 further comprising a suction adjustment element, wherein the suction adjustment is in fluid communication with the tissue-contacting chamber.

3. The apparatus of claim 1 wherein parameters of the motor type stimulators are controlled and the parameters are selected from the group consisting of vibrational frequency, vibrational intensity, vibrational duration, sequence of motor vibration, and combinations thereof.

4. The apparatus of claim 3 wherein the motor type stimulators are controlled by selecting from a pre-programmed algorithm, a user-customizable algorithm, or combinations thereof.

5. The apparatus of claim 1 comprising a wearable device body with an attachment area that is adapted to fit the female user between the labia majora inferior to the clitoris and a housing that exits the labia majora superior to the clitoris, the attachment area having a length and the housing a height that allow intercourse.

6. The apparatus of claim 5 comprising three stimulators in a triangular-spaced relationship forming a clitoral tissue cavity.

7. The apparatus of claim 1 wherein the motor type stimulators are miniature coin style motors.

8. The apparatus of claim 6 wherein the miniature coin style motors are encapsulated in a convex shape membrane.

9. The apparatus of claim 1 further comprising a suction-generating device and a wearable device body, wherein the suction-generating device is detachable from the wearable device body.

10. The apparatus of claim 9 wherein the motor type stimulators remain substantially in contact with tissue after the suction-generating device is detached.

11. The apparatus of claim 1 further comprising a membrane at least partially encapsulating at least one of the stimulators.

12. The apparatus of claim 11 wherein the membrane is coupled to the chamber.

13. The apparatus of claim 12 wherein the motor type stimulators are flexibly suspended via the membrane.

14. The apparatus of claim 11 wherein the membrane is configured to be displaceable by the user's clitoris.

15. The apparatus of claim 1 wherein the stimulators are controlled such that the user experiences simulated macroscopic motion.

16. The apparatus of claim 1 wherein vibration generated by one stimulator is isolated from a wall of the tissue-contacting chamber.

17. An apparatus for promoting sexual arousal in a female user, comprising:

a tissue-contacting chamber including a suction chamber, the suction chamber being in fluid connection with a programmable suction pump; and at least two motors mounted within the suction chamber;

wherein the motors and the suction pump are configured to be independently controllable via a control circuit.

18. The apparatus of claim 17 further comprising a controller block, wherein the controller block includes pre-loaded vibration patterns and pre-loaded suction patterns.

19. The apparatus of claim 18 wherein the controller block is configured to allow a user to create vibration patterns and suction patterns.

20. The apparatus of claim 17 wherein the apparatus comprises a wearable device body and the programmable suction pump is mounted within the device body.

* * * * *